US010392828B2

(12) United States Patent
Johnson et al.

(10) Patent No.: US 10,392,828 B2
(45) Date of Patent: Aug. 27, 2019

(54) RAPIDLY DEPLOYABLE MODULAR SHELTER SYSTEM

(71) Applicant: WEATHERHAVEN GLOBAL RESOURCES LTD., Coquitlam (CA)

(72) Inventors: Brian D. Johnson, Mill Bay (CA); Ryan Douglas Savenkoff, Vancouver (CA)

(73) Assignee: WEATHERHAVEN GLOBAL RESOURCES LTD., Coquitlam (CA)

( * ) Notice: Subject to any disclaimer, the term of this patent is extended or adjusted under 35 U.S.C. 154(b) by 0 days.

(21) Appl. No.: 16/072,124

(22) PCT Filed: Jan. 25, 2017

(86) PCT No.: PCT/CA2017/050071

§ 371 (c)(1),
(2) Date: Jul. 23, 2018

(87) PCT Pub. No.: WO2017/127920

PCT Pub. Date: Aug. 3, 2017

(65) Prior Publication Data

US 2019/0032361 A1 Jan. 31, 2019

Related U.S. Application Data

(60) Provisional application No. 62/287,313, filed on Jan. 26, 2016.

(51) Int. Cl.

| | |
|---|---|
| ***E04H 15/48*** | (2006.01) |
| ***E04H 15/44*** | (2006.01) |
| ***E04H 15/18*** | (2006.01) |
| *E04H 15/36* | (2006.01) |

(52) U.S. Cl.
CPC ..... *E04H 15/48* (2013.01); *E04H 15/18* (2013.01); *E04H 15/44* (2013.01); *E04H 15/36* (2013.01)

(58) Field of Classification Search
CPC ..... E04H 15/44; E04H 15/48
See application file for complete search history.

(56) References Cited

U.S. PATENT DOCUMENTS

| | | | |
|---|---|---|---|
| 1,170,188 | A | 2/1916 | Rassmussen et al. |
| 2,771,896 | A | 11/1956 | Call |
| 2,828,756 | A | 4/1958 | Worley |
| 3,564,784 | A | 2/1971 | Mollinger |
| 4,066,089 | A | 1/1978 | Rainwater |
| 4,365,908 | A | 12/1982 | Thiboutot |
| 4,667,692 | A | 5/1987 | Tury et al. |
| 5,159,790 | A | 11/1992 | Harding |

(Continued)

FOREIGN PATENT DOCUMENTS

| | | | |
|---|---|---|---|
| CA | 1287725 | A | 8/1991 |
| CN | 201169955 | Y | 12/2008 |

(Continued)

*Primary Examiner* — Noah Chandler Hawk
(74) *Attorney, Agent, or Firm* — Bruce M. Green; Oyen Wiggs Green & Mutala, LLP

(57) ABSTRACT

A modular tent frame system includes a number of folding frame elements which permit the shelter to be rapidly deployed. The folding elements incorporate joints with self-resetting lock mechanisms. During set up they automatically lock the joints into place and once unlocked they reset to automatically lock the joints into place on the next setup.

5 Claims, 50 Drawing Sheets

(56) References Cited

U.S. PATENT DOCUMENTS

| | | | | |
|---|---|---|---|---|
| 5,167,246 | A | 12/1992 | Mortenson | |
| 5,263,507 | A | 11/1993 | Chuang | |
| 5,771,651 | A | 6/1998 | Shiina | |
| 5,884,647 | A | 3/1999 | Dwek | |
| 6,550,491 | B1 | 4/2003 | Bixler et al. | |
| 7,290,553 | B2 | 11/2007 | Prevost | |
| 7,975,712 | B2 | 7/2011 | Beacco | |
| 8,033,289 | B2 | 10/2011 | Buckley | |
| 8,186,369 | B2 | 5/2012 | Reeb et al. | |
| 8,205,627 | B2 * | 6/2012 | Zhou | E04H 15/48 135/114 |
| 2005/0217713 | A1 | 10/2005 | Chu et al. | |
| 2011/0284044 | A1 | 11/2011 | Baldussi | |
| 2016/0265246 | A1 * | 9/2016 | Becher | E04H 15/46 |

FOREIGN PATENT DOCUMENTS

| | | | |
|---|---|---|---|
| CN | 101463671 | A | 6/2009 |
| EP | 0020770 | A1 | 1/1981 |
| EP | 0248540 | A | 12/1987 |
| EP | 0494053 | A1 | 7/1992 |
| EP | 0534843 | A1 | 3/1993 |
| GB | 680294 | A | 10/1952 |
| GB | 982411 | A | 2/1965 |
| GB | 2254630 | A | 10/1992 |
| GB | 2475512 | A | 5/2011 |
| WO | 2008120071 | A2 | 10/2008 |

* cited by examiner

RAPIDLY DEPLOYABLE MODULAR SHELTER SYSTEM

REFERENCE TO RELATED APPLICATIONS

The present application claims the benefits, under 35 U.S.C. § 119(e), of U.S. Provisional Application Ser. No. 62/287,313 filed Jan. 26, 2016 entitled "RAPIDLY DEPLOYABLE MODULAR SHELTER SYSTEM" which is incorporated herein by this reference

TECHNICAL FIELD

The invention relates to the field of collapsible structures, in particular fabric-covered structures such as tents and collapsible frames for supporting same.

BACKGROUND

Numerous designs have been developed for large-scale collapsible fabric-covered structures which are portable and can be rapidly erected and disassembled. Such structures have use in military applications, for resource exploration, for large public events such as concerts and festivals and the like. Typically the frames for such structures consist of multiple separate pieces which can become misplaced and are complicated to assemble, dis-assemble and pack for shipment. There is therefore a need for more simple and efficient frames for large-scale collapsible structures.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above described problems have been reduced or eliminated, while other embodiments are directed to other improvements.

The present invention therefore provides a modular shelter system comprising a number of folding frame elements which is rapidly deployable. The folding elements incorporate joints with self-resetting lock mechanisms. During set up they automatically lock the joints into place and once unlocked they reset to automatically lock the joints into place on the next setup. Certain joint locks contain a further feature which allows joints to be set into an unlocked position until the joint is bent, at which time the lock resets, ready to lock the joint into position on the next setup. The system may use a quick release foot designed to allow a special high wind set up and tear down procedure, where the feet are removed from the legs before setup, attached to the shelter's floor, and securely anchored to the ground. When the frame is erected, the legs snap into the pre-anchored feet. For the shelter take-down, the feet can be released from the leg assembly by the user's foot to allow both hands to grasp on the leg at all times.

More particularly there provided a folding tent frame component comprising: a) first and second frame elements pivotally attached for relative rotation about a first axis of rotation located in the first element, between an open position capable of forming part of an erected tent frame and a closed folded position, the second frame element comprising a first end engaging the first axis of rotation; b) a sliding locking frame slideably movable in the second frame element, the sliding locking frame comprising a locking pin secured thereto and a lock-out bar pivotally mounted thereon and extending therefrom, c) first biasing means for biasing the sliding locking frame towards the first end of the second frame element and second biasing means for biasing said lock-out bar away from said sliding locking frame to an upward position;

wherein said first frame element comprises a pin-receiving slot with a closed end in the direction towards the axis of rotation and open in the opposite direction away from the axis of rotation for reversibly receiving the locking pin when the first and second frame elements are in the open position, and an opening for reversibly receiving a portion of the lockout bar when the sliding locking frame is moved away from the axis of rotation to withdraw the locking pin from the pin-receiving slot;

whereby when the locking pin is received in the pin-receiving slot the first and second frame elements are locked in the open position in the absence of other forces on the sliding locking frame, and when the sliding locking frame is moved away from the axis of rotation to withdraw the locking pin from the pin-receiving slot, the portion of the lock-out bar moves into the opening for reversibly receiving the portion of the lockout bar to thereby prevent the sliding locking frame from moving back towards said axis of rotation to again lock the first and second frame elements in the open position, and when the portion of the lock-out bar is received in the opening for reversibly receiving the portion of the lockout bar the first and second frame elements can be rotated to the second closed folded position; and whereby when the first and second frame elements are rotated back to the open position the locking pin is moved back into the pin-receiving slot by the first biasing means to thereby again lock the first and second frame elements in said open position.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
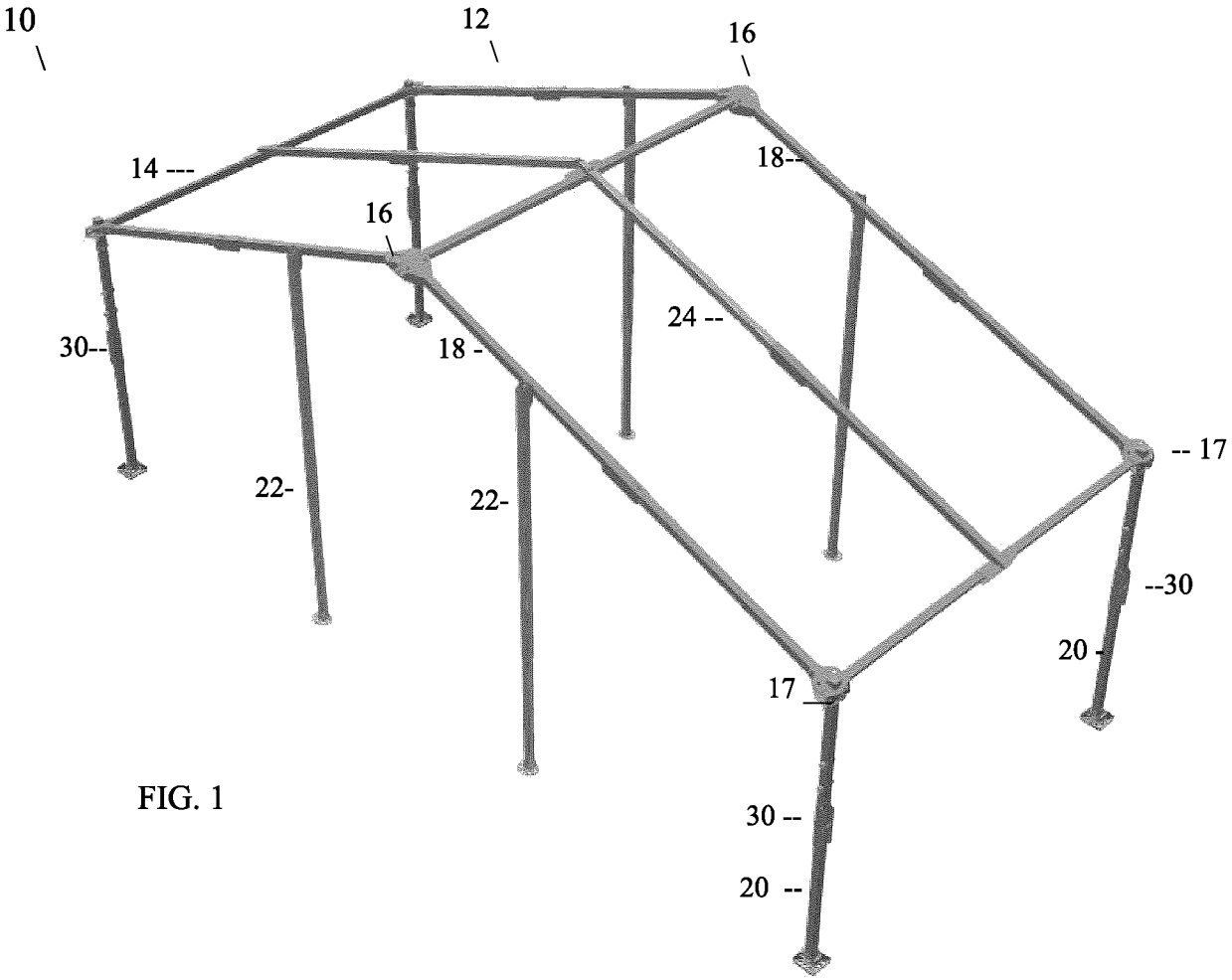
FIG. 1 is a perspective view of the unfolded assembled frame for a one bay structure according to an embodiment of the invention.
Figure 34:
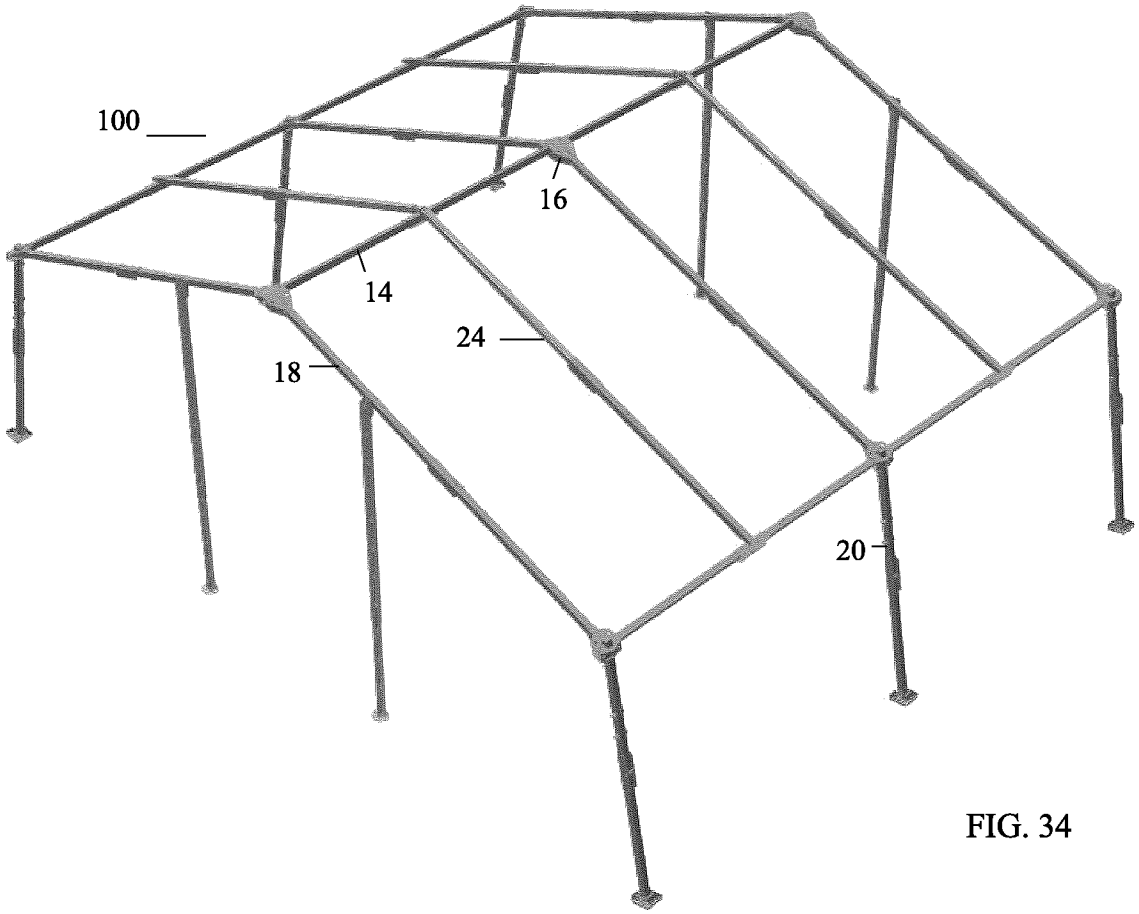
FIG. 34 is a perspective view of the unfolded assembled frame for a two bay structure according to an embodiment of the invention.
Figure 35:
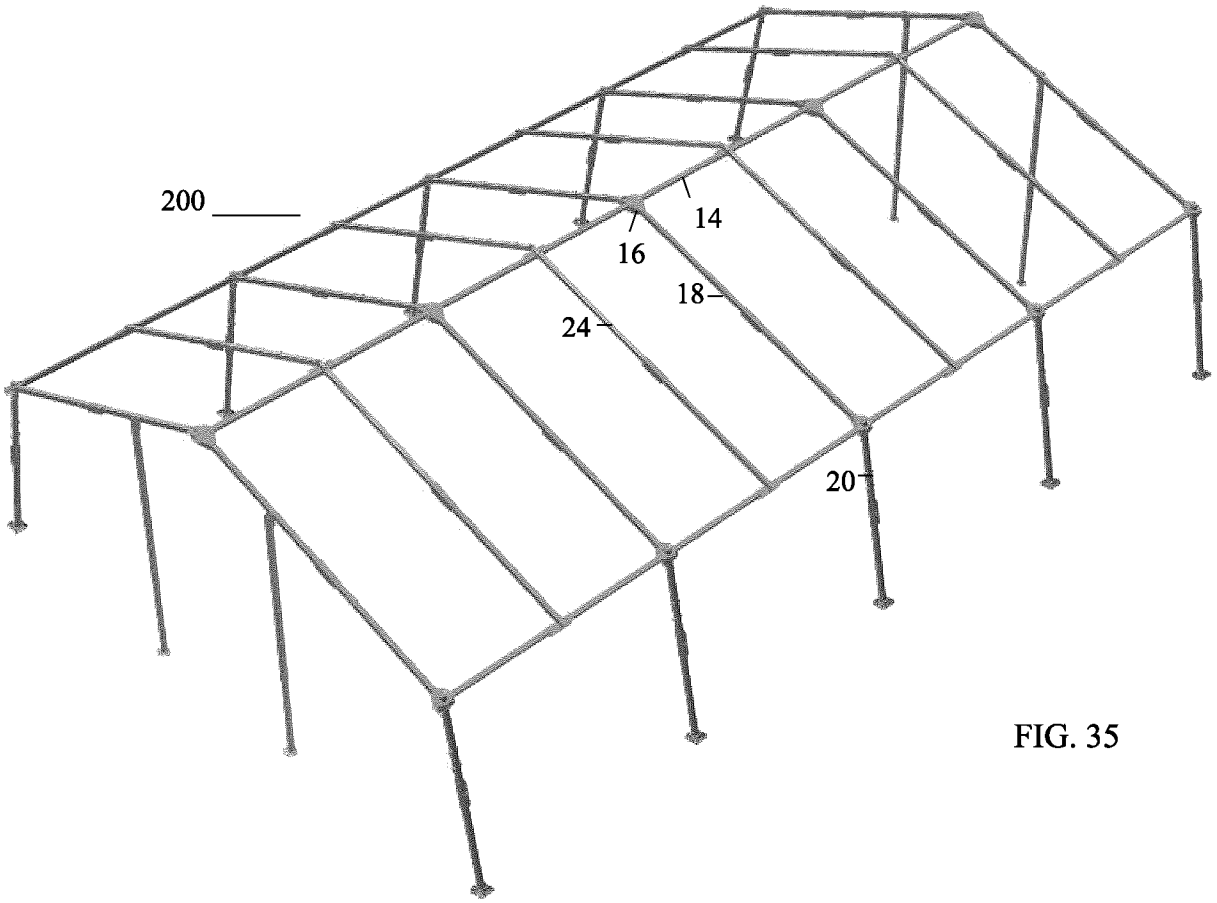
FIG. 35 is a perspective view of the unfolded assembled frame for a four bay structure according to an embodiment of the invention.

With reference to FIG. 1, an unfolded frame assembly 10 for a one bay structure according to an embodiment of the invention is shown. Unfolded frame assemblies 100 and 200 for two and four bay structures according to an embodiment of the invention are shown in FIGS. 34 and 35. Each frame assembly 10 comprises an upper section assembly 12 (FIG. 2) which includes fully attached folding purlins 14. Frame assembly 10 also comprises peak brackets 16, eave brackets 17, chords 18, legs 20, wind kit posts 22, midspan chords 24, chord knee joints 26, purlin knee joints 28, and leg knee joints 30. Such joints contain self-resetting lock mechanisms as described below. During set up they lock the joints into place without needing to be touched. Once unlocked they reset to automatically lock the joints into place on the next setup.

Peak bracket and chord joint locks contain a secondary feature which allows joints to be set into an unlocked position until the joint is bent, at which time the lock resets, ready to lock the joint into position on the next setup. This facilitates the pack up procedure, as multiple joint locks need not be manually held unlocked at the same time.

Figure 2:
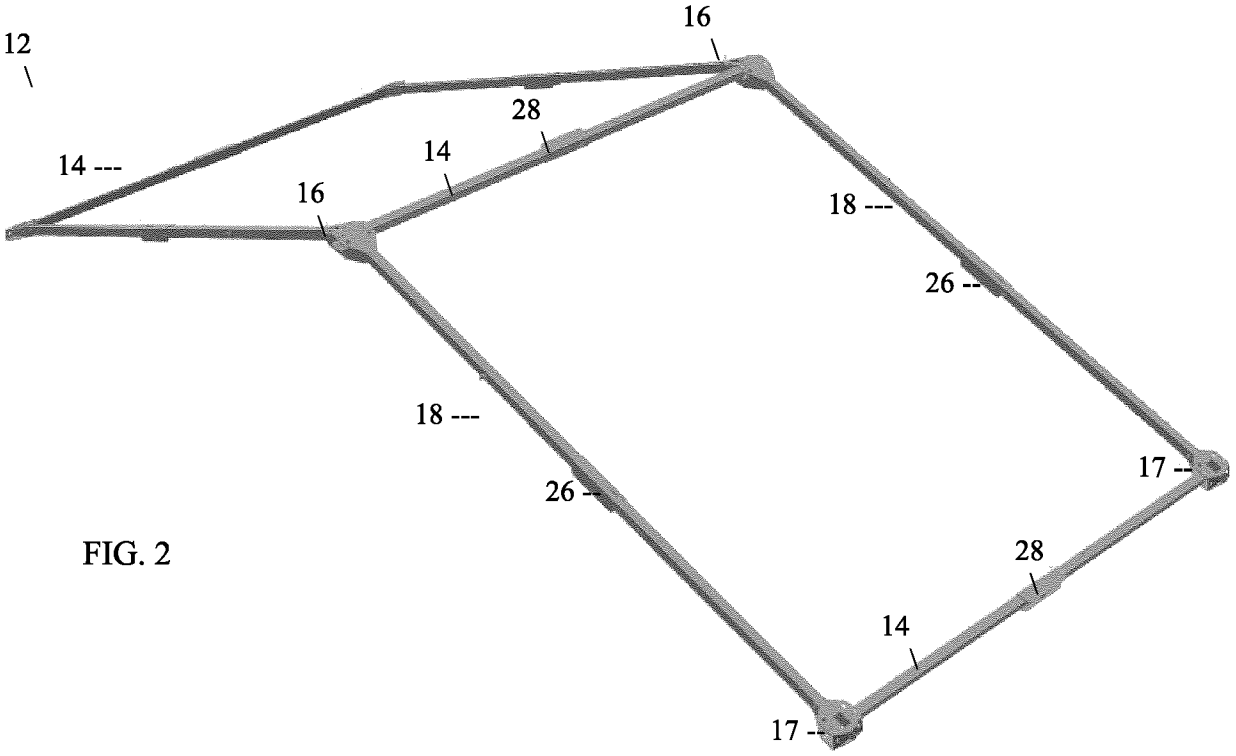
FIG. 2 is a perspective view of the upper folding assembly for the frame in FIG. 1, expanded with frame components unfolded.
Figure 3:
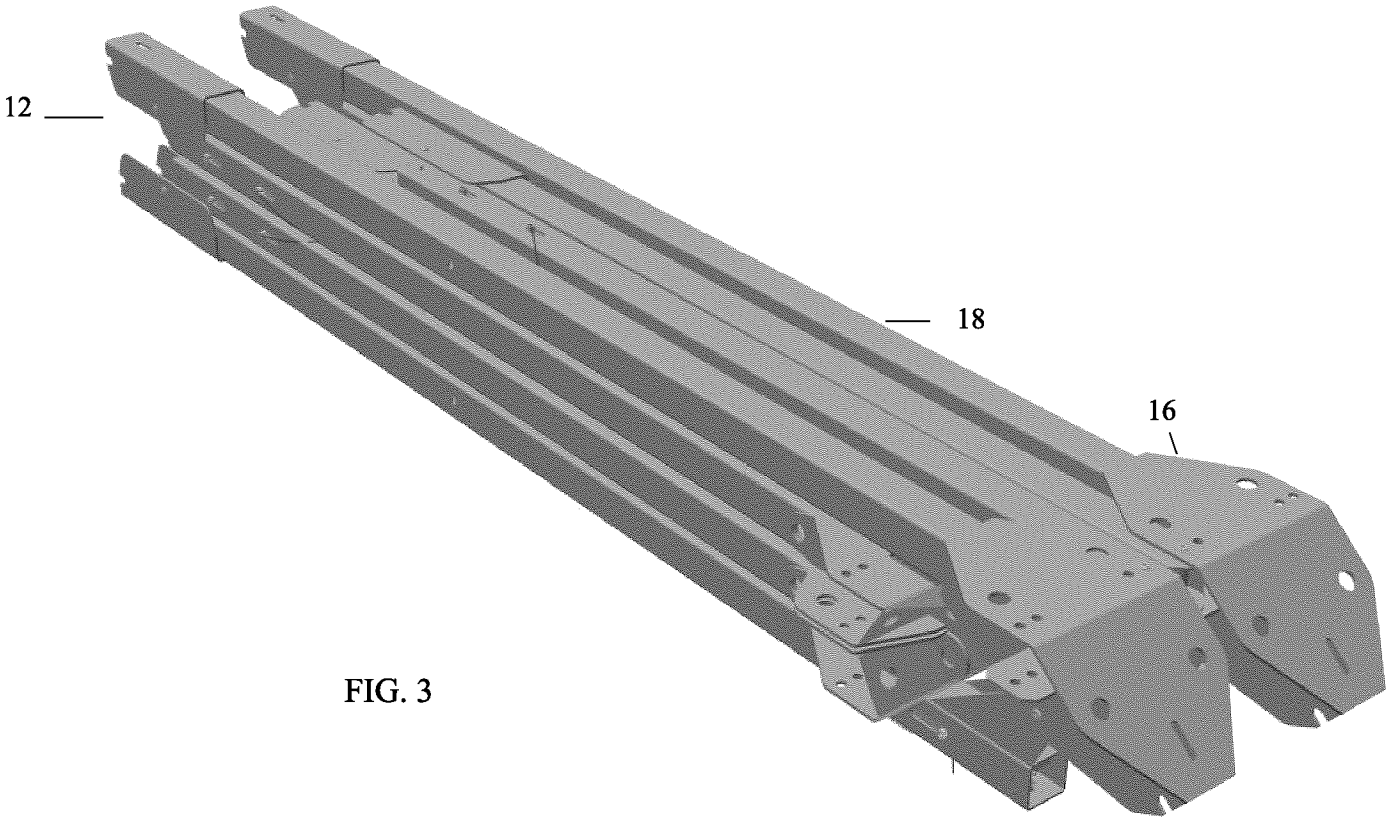
FIG. 3 is a perspective view of the upper folding assembly for the frame as shown in FIG. 2, folded for packing.
Figure 4:
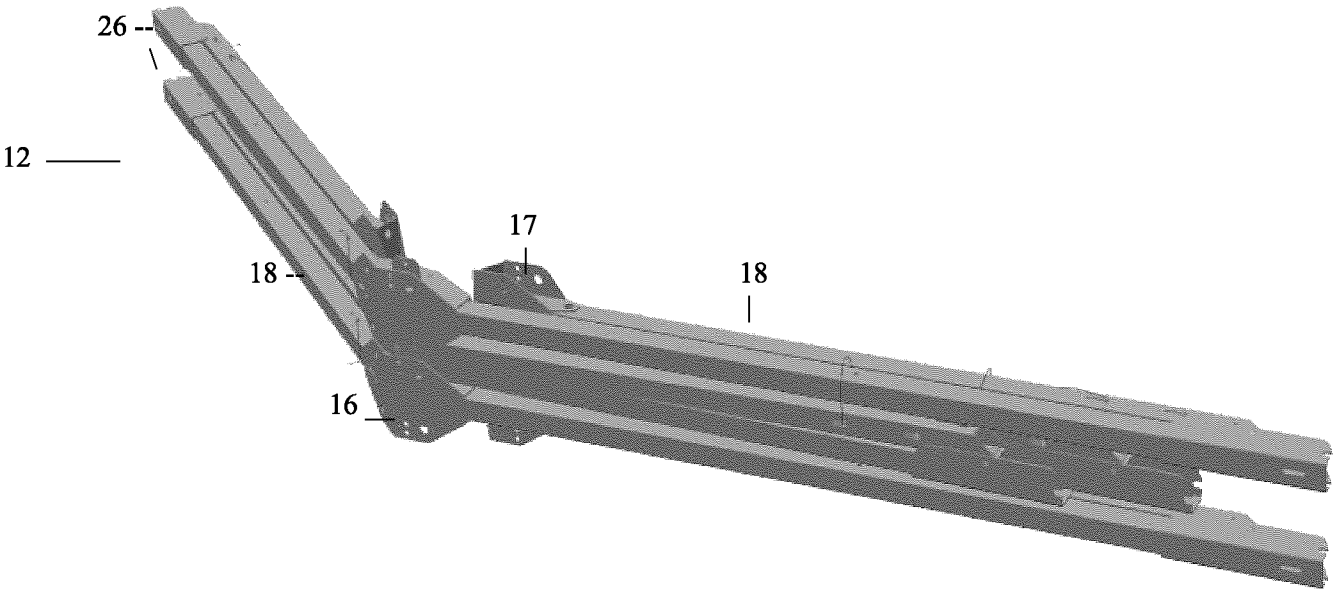
FIG. 4 is a perspective view of the upper folding assembly for the frame as shown in FIG. 2, partially unfolded.
Figure 5:
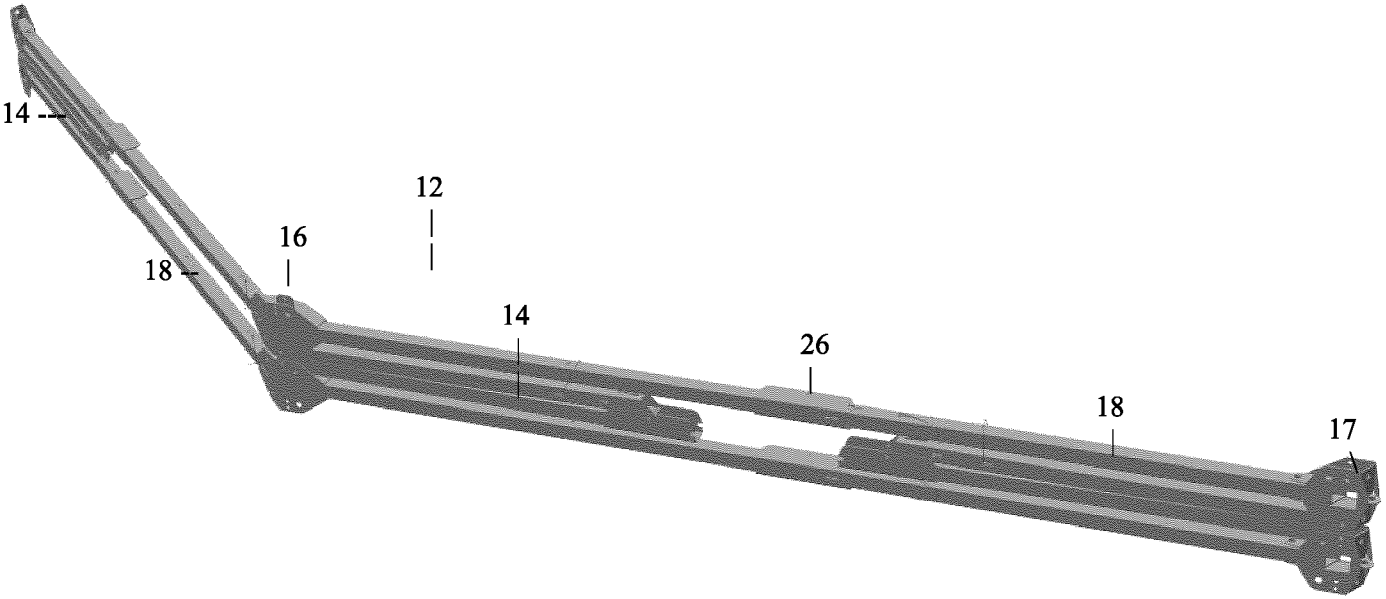
FIG. 5 is a perspective view of the upper folding assembly for the frame as shown in FIG. 2, further unfolded.
Figure 6:
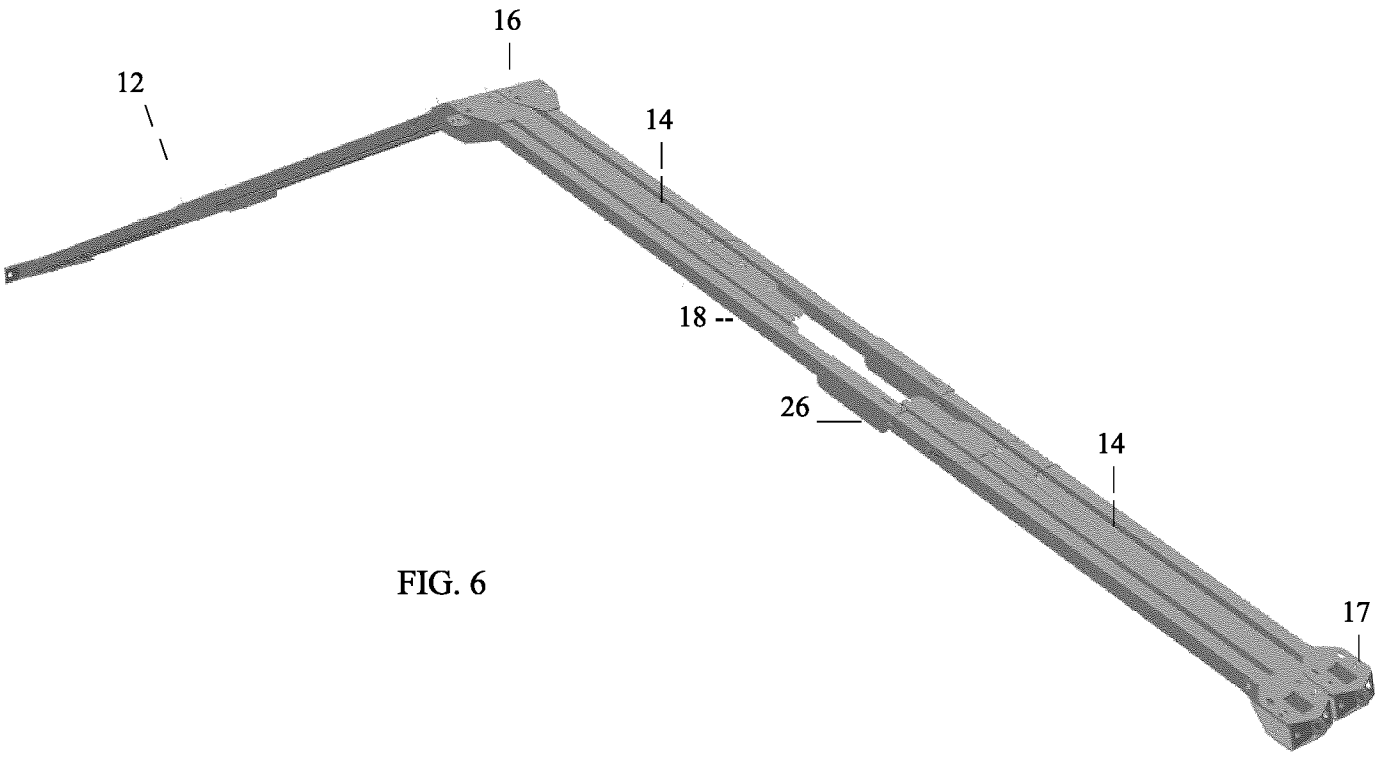
FIG. 6 is a perspective view of the upper folding assembly for the frame as shown in FIG. 2, further unfolded and standing upright.
Figure 7:
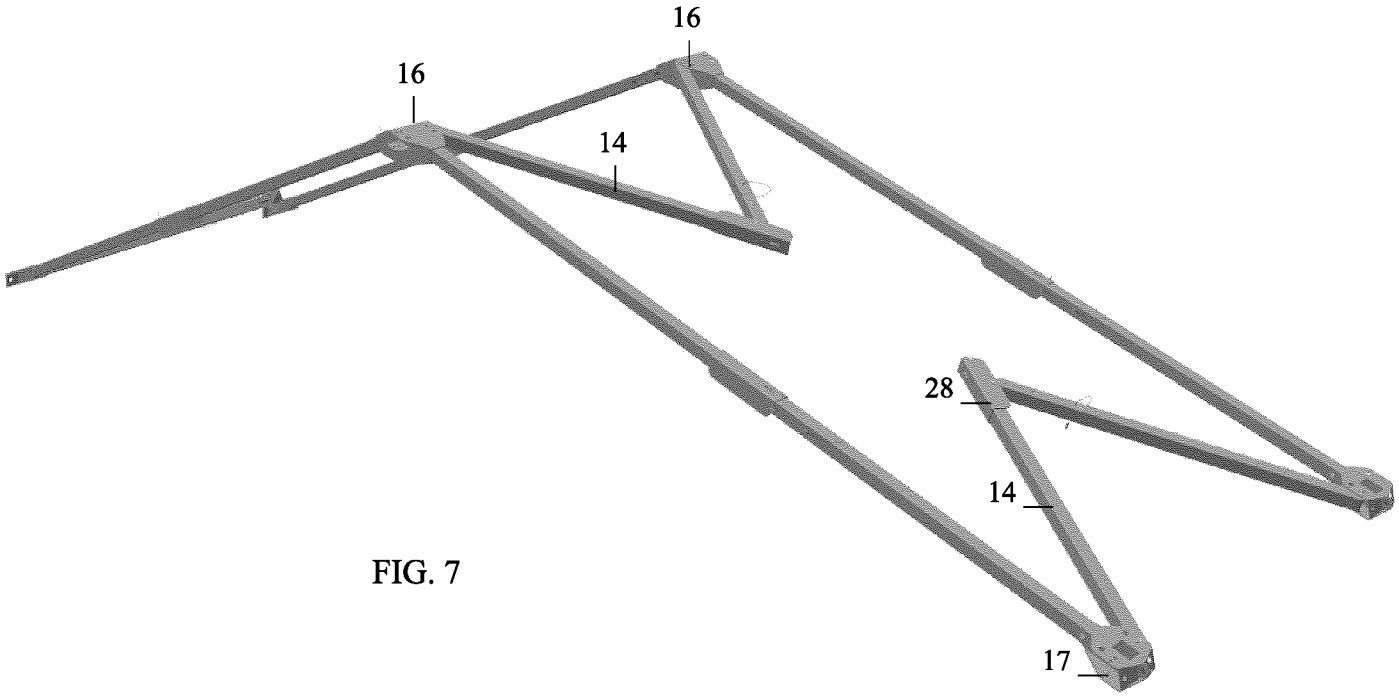
FIG. 7 is a perspective view of the upper folding assembly for the frame as shown in FIG. 2, standing upright further unfolded.
Figure 8:
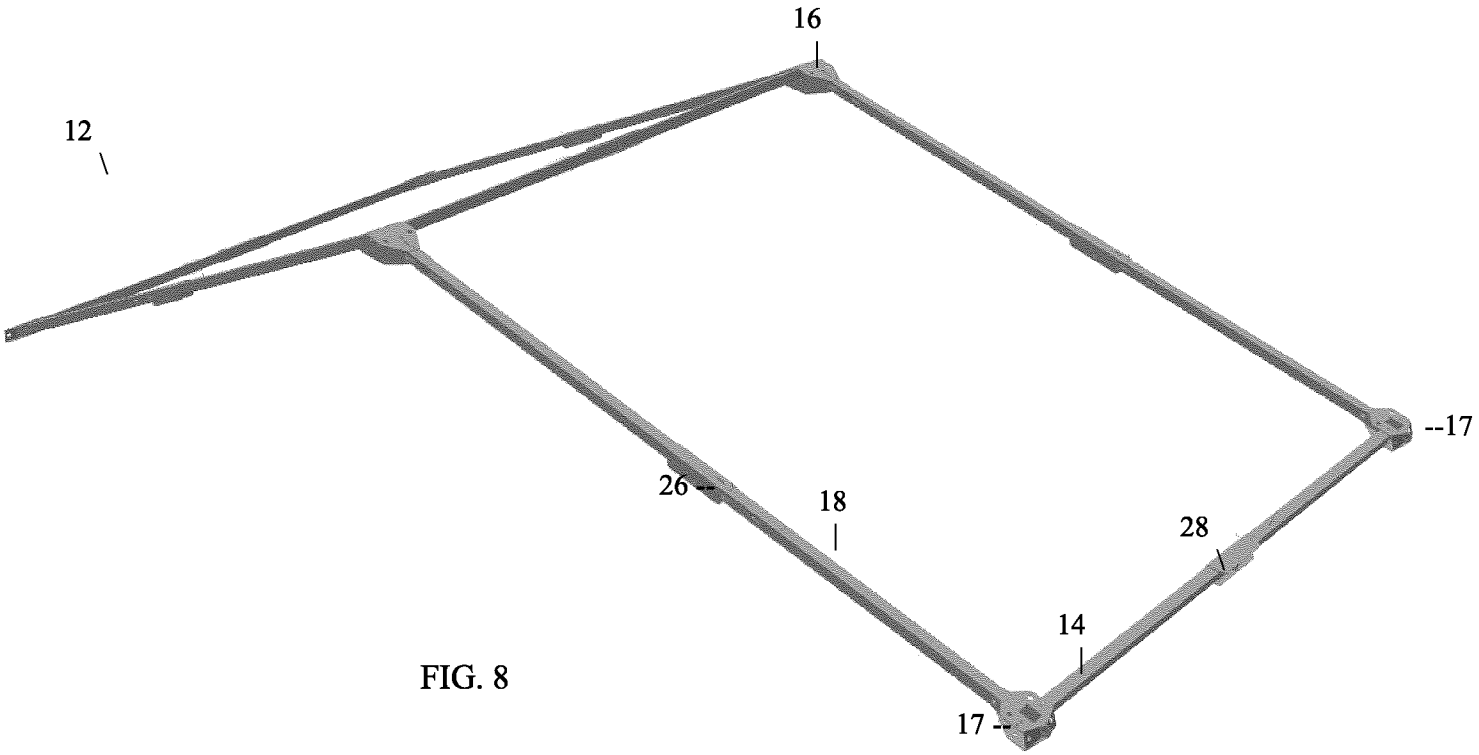
FIG. 8 is a perspective view of the upper folding assembly for the frame as shown in FIG. 2, standing upright completely unfolded.

FIG. 3 shows the upper folding assembly 12 for the frame as shown in FIGS. 1 and 2, folded for packing. In FIG. 4 one set of two folded chords 18 and one folded purlin 14 are rotated about the hinged peak bracket 16 to separate from the set of two folded chords 18 and two folded purlin 14. In FIG. 5 the chords 18 are unfolded by rotating at chord knee joints 26. In FIG. 6 the partially unfolded upper frame assembly is placed in an upright position and as shown in FIG. 7 purlins 14 are unfolded about hinged purlin knee joints 28, to reach the unfolded configuration shown in FIG. 8.

Figure 9:
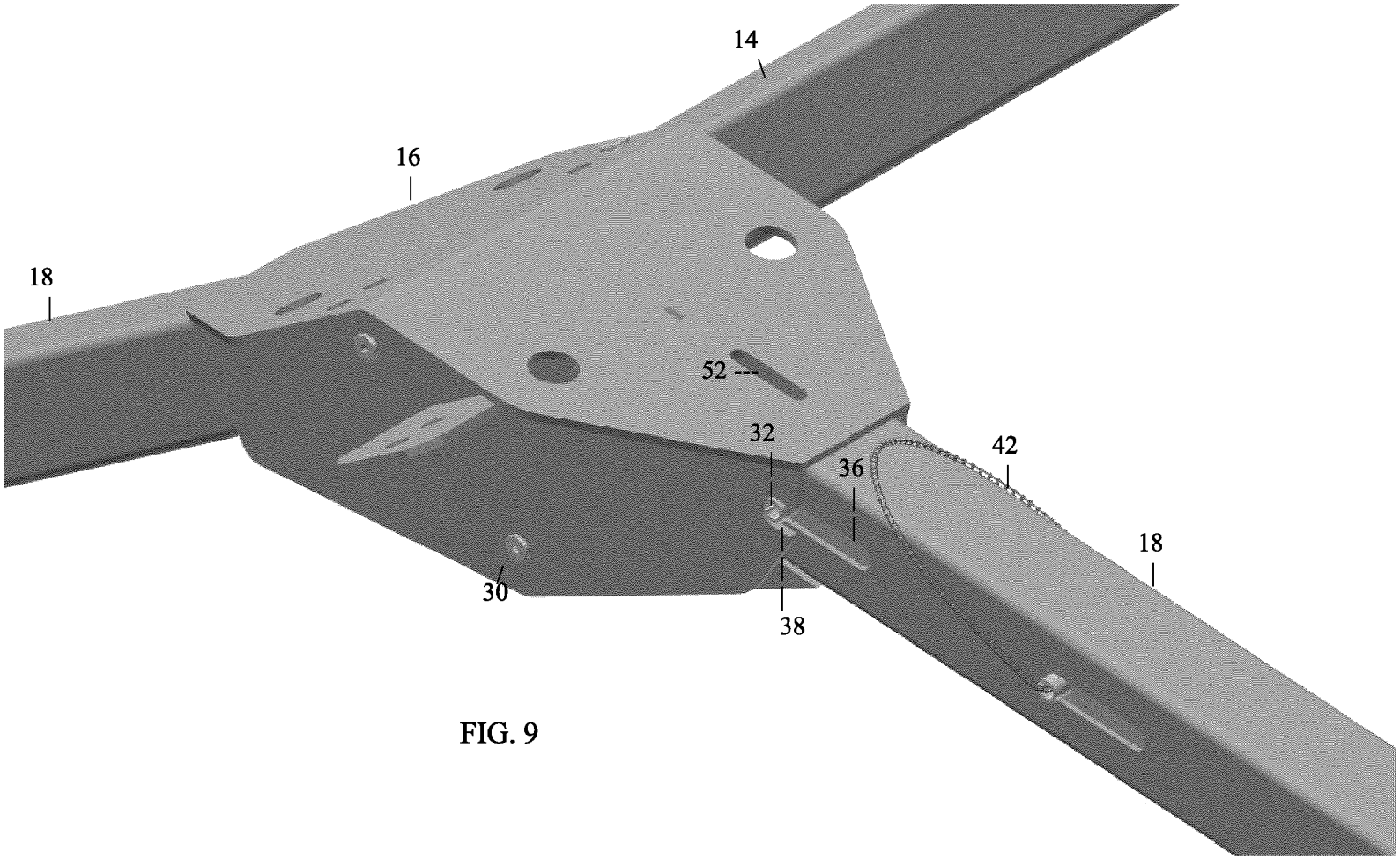
FIG. 9 is a perspective view of a Peak Bracket.
Figure 10:
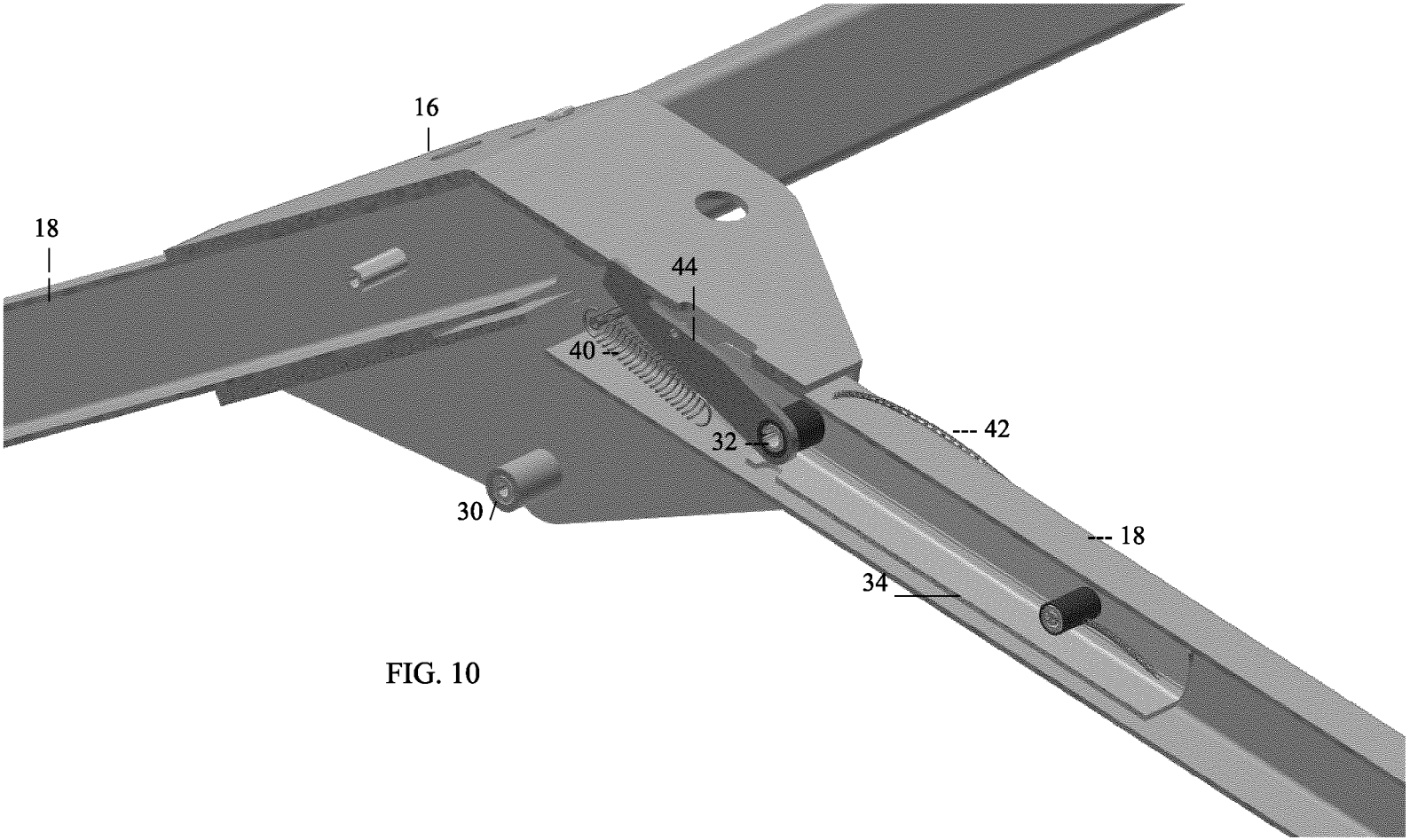
FIG. 10 is a perspective view of the Peak Bracket shown in FIG. 9 partially in cross-section, showing chord connections, peak hinge, and sliding lock mechanism with lockout feature.

Peak brackets 16 are hingedly connected to chord 18 about axis 30. When in the unfolded position shown in FIGS. 9 and 10, the chord 18 is locked in place by pins 32 which are mounted on interior sliding locking frame 34 and extend through slots 36 in the sides of chords 18, and into slots 38. Pins 32 are biased by spring 40 into the locked position shown in FIG. 9. Pulling on cable 42 slides sub-frame 34 away from the peak bracket 16, releasing pin 32 from slot 38 and allowing chord 18 to rotate.

Thus peak bracket joints, chord knee joints, purlin knee joints, and leg knee joints all contain self-resetting lock mechanisms. During set up they lock the joints into place without needing to be touched. Once unlocked they reset to automatically lock the joints into place on the next setup.

Figure 11:
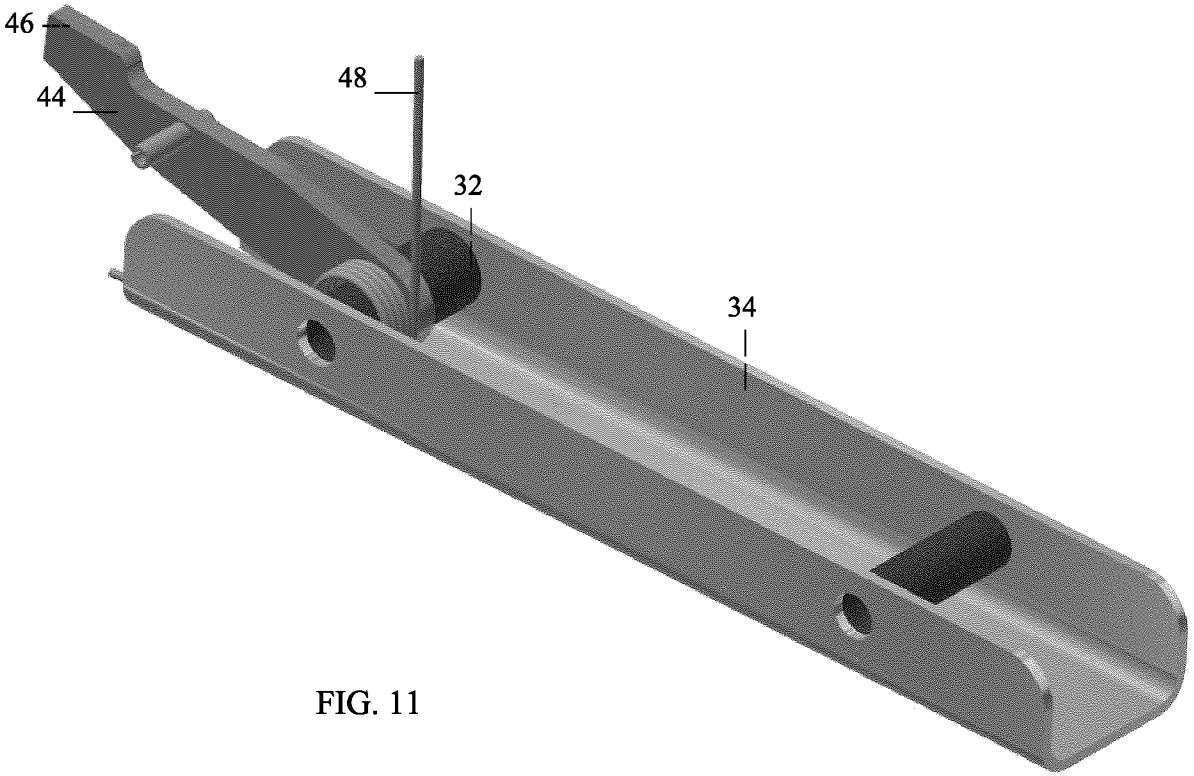
FIG. 11 is a perspective view of a detail of the sliding lock mechanism with lockout feature.

As previously noted peak brackets 16 and chord knee joints 26, contain a secondary lockout feature which allows joints to be set into an unlocked position until the joint is bent, at which time the lock resets, ready to lock the joint into position on the next setup. This assists the pack up procedure, as multiple joint locks didn't need to be manually held unlocked at the same time. Lockout bars 44 permit the chords 18 to be kept in an extended unfolded position without locking. With reference to FIG. 11, lockout bar 44 is hingedly mounted on pin 32 on sliding locking frame 34. It is biased to an upward position by spring 48. Head 46 is sized to move upwardly into slot 50 of chord knee joint 26 or slot 52 of peak bracket 16. By pulling on cable 42 the operator can unlock the joint by allowing head 46 to extend into slot 50/52 to prevent the joint from re-locking while keeping the joint unfolded. Once the joint is bent, head 46 comes out of slot 50/52 at which time the lock resets, ready to lock the joint into position on the next setup.

Figure 12:
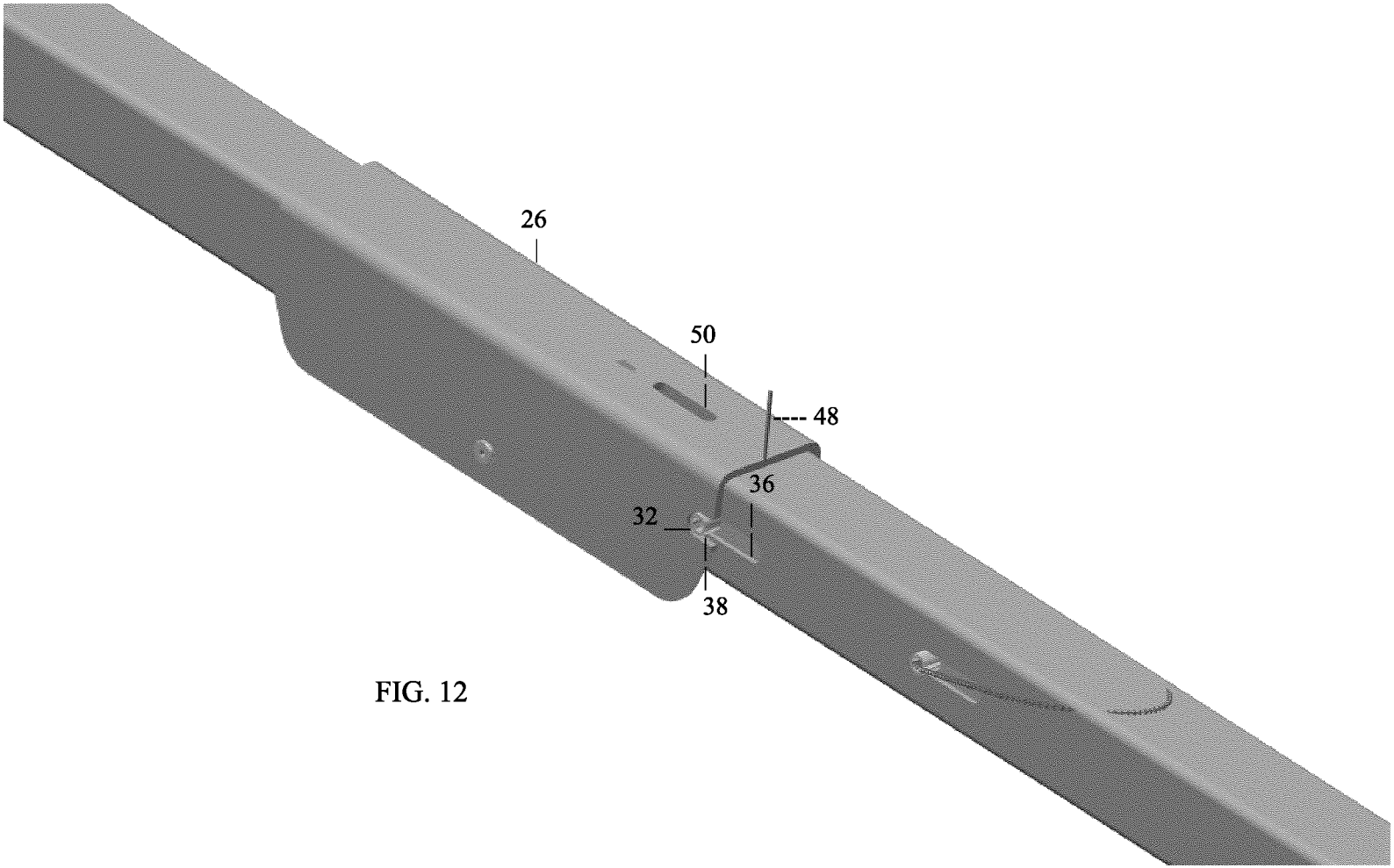
FIG. 12 is a perspective view of the chord knee bracket.
Figure 13:
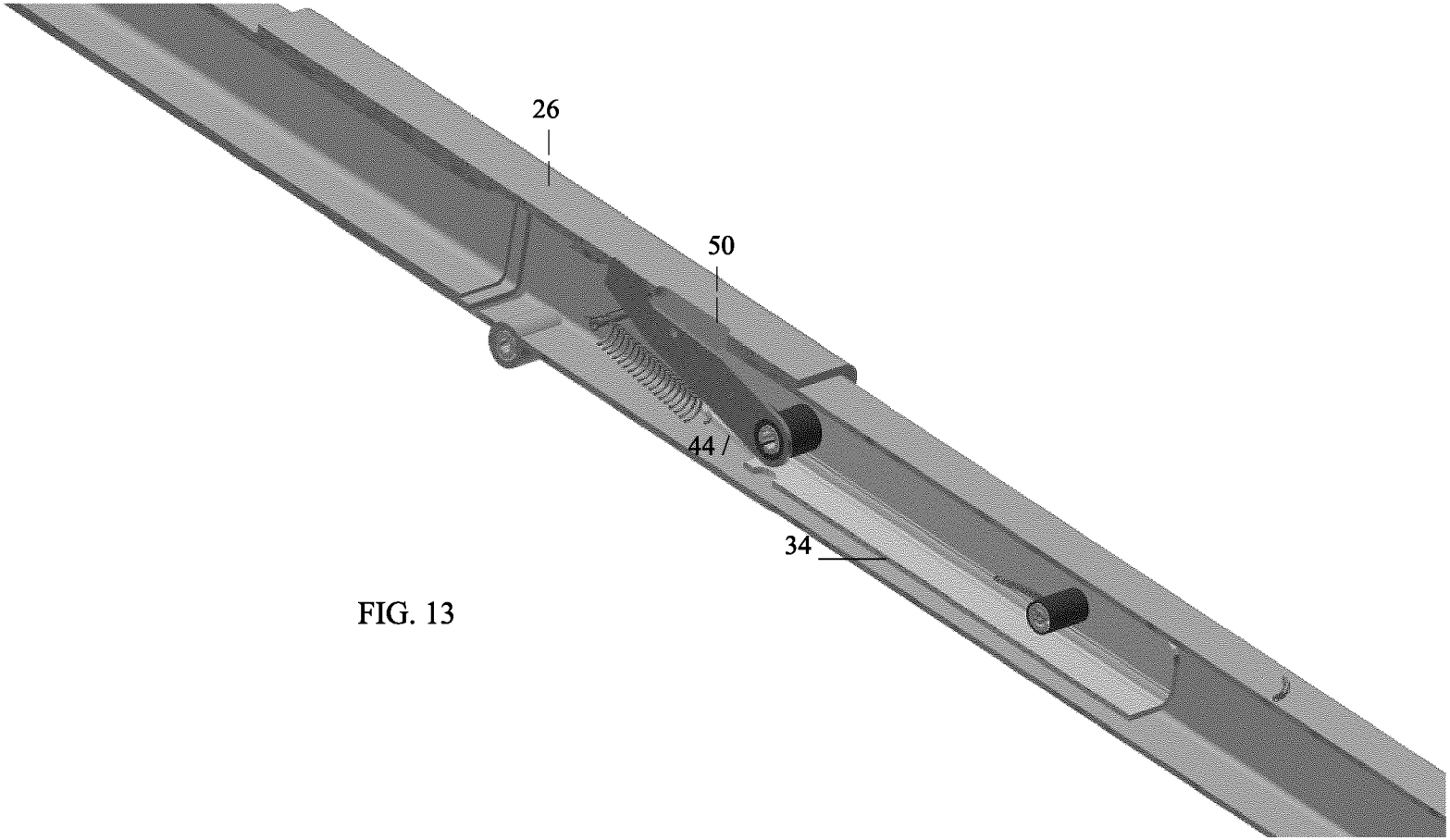
FIG. 13 is a perspective view partially in cross-section of the chord knee bracket of FIG. 12 showing the sliding lock mechanism with lockout feature.

Chord knee bracket shown in FIGS. 12 and 13 operates in the same way as the peak bracket 16 using sliding locking frame 34.

Figure 14:
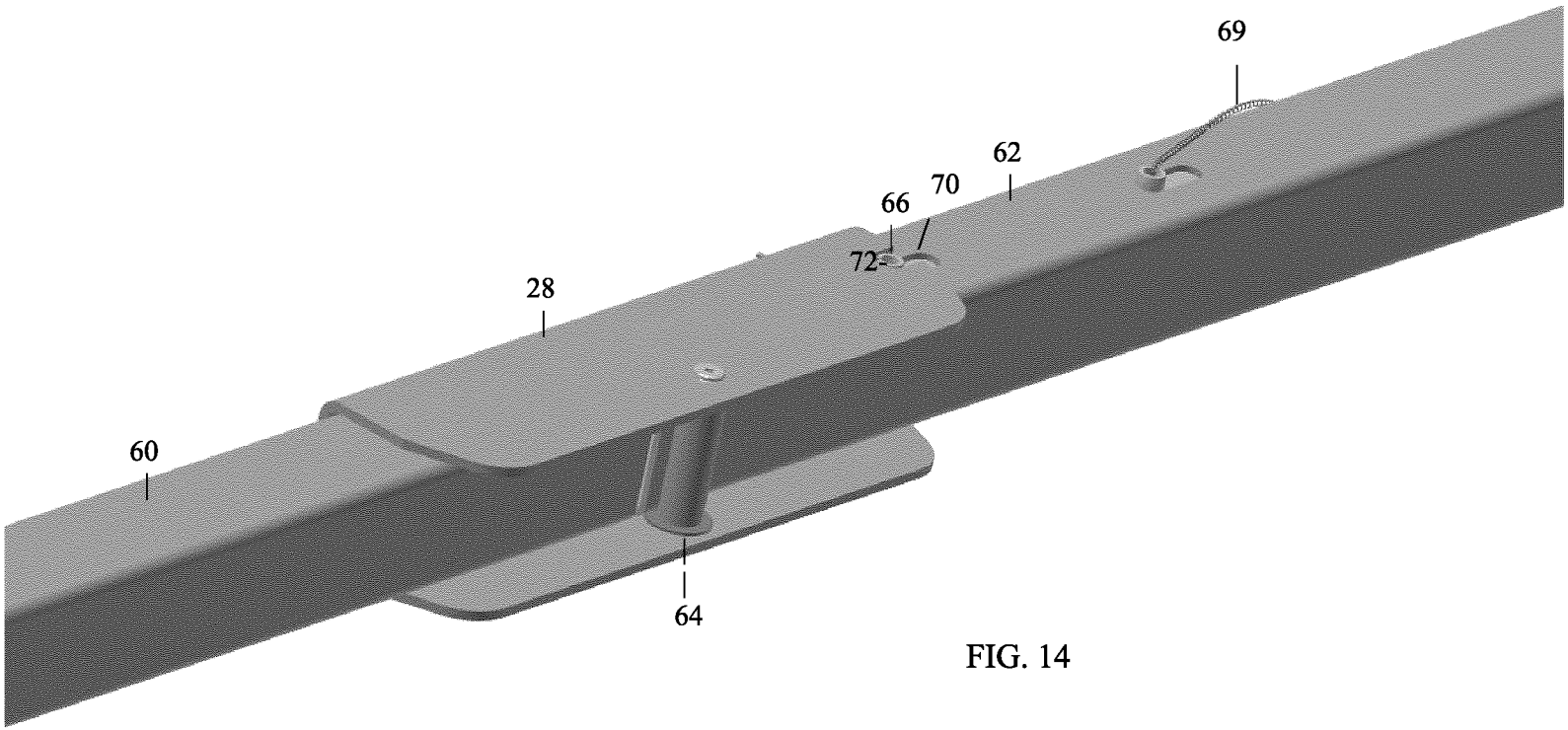
FIG. 14 is a perspective view of a purlin knee bracket.
Figure 15:
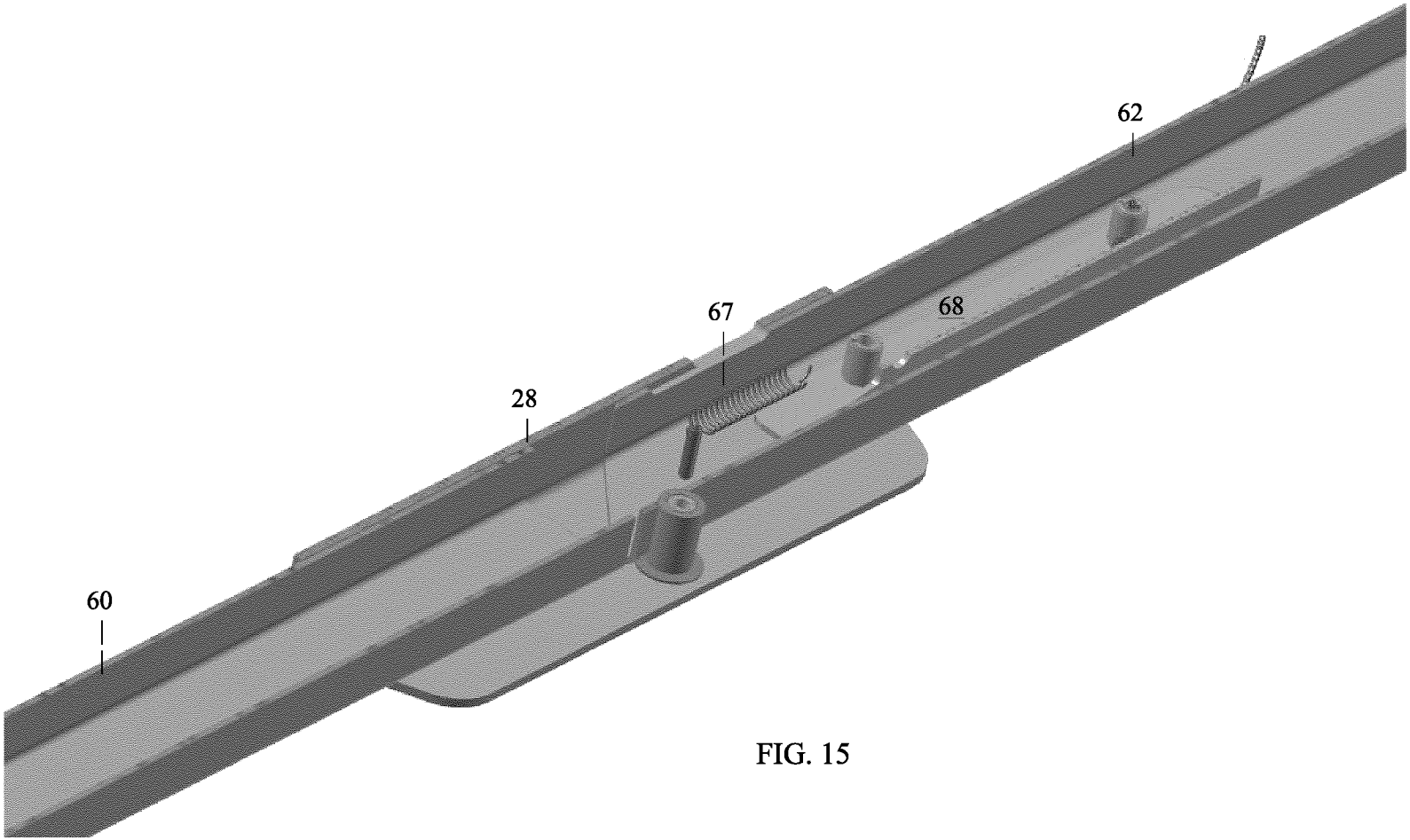
FIG. 15 is a detail front perspective view partially in cross-section of the purlin knee Bracket of FIG. 14, with sliding lock mechanism but no lockout feature.
Figure 16:
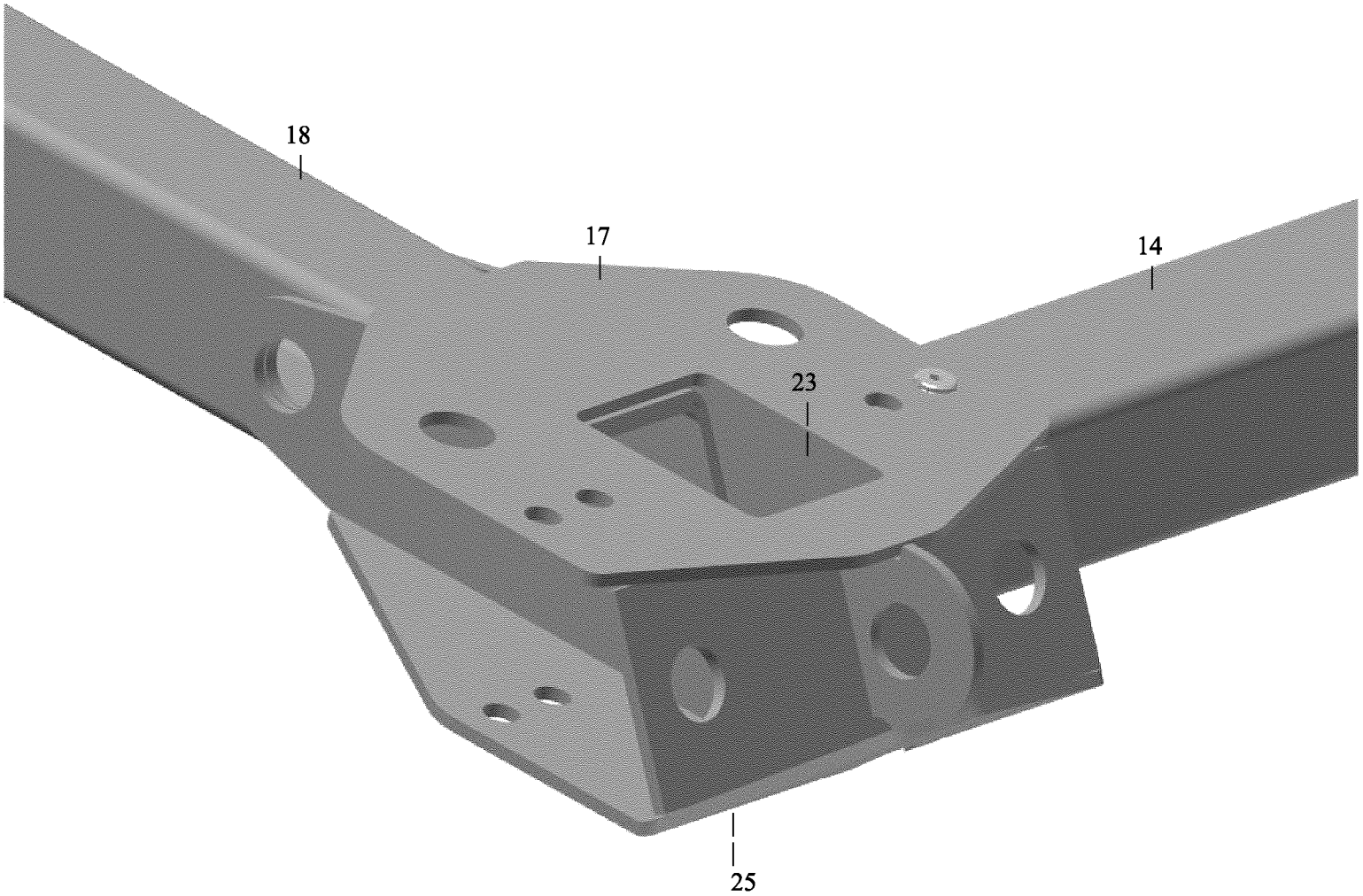
FIG. 16 is a detail rear perspective view of an eave bracket.
Figure 17:
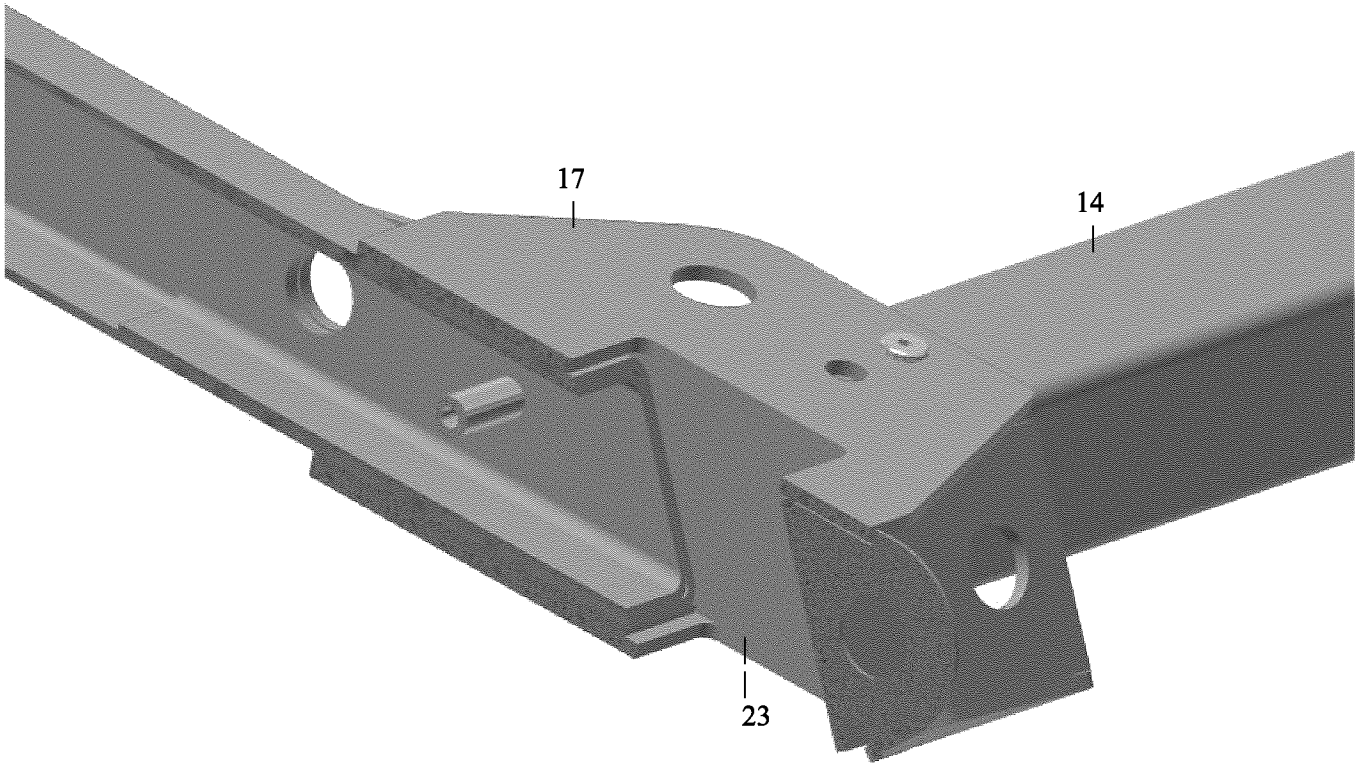
FIG. 17 is a detail perspective view partially in cross-section of the eave bracket of FIG. 16.
Figure 18:
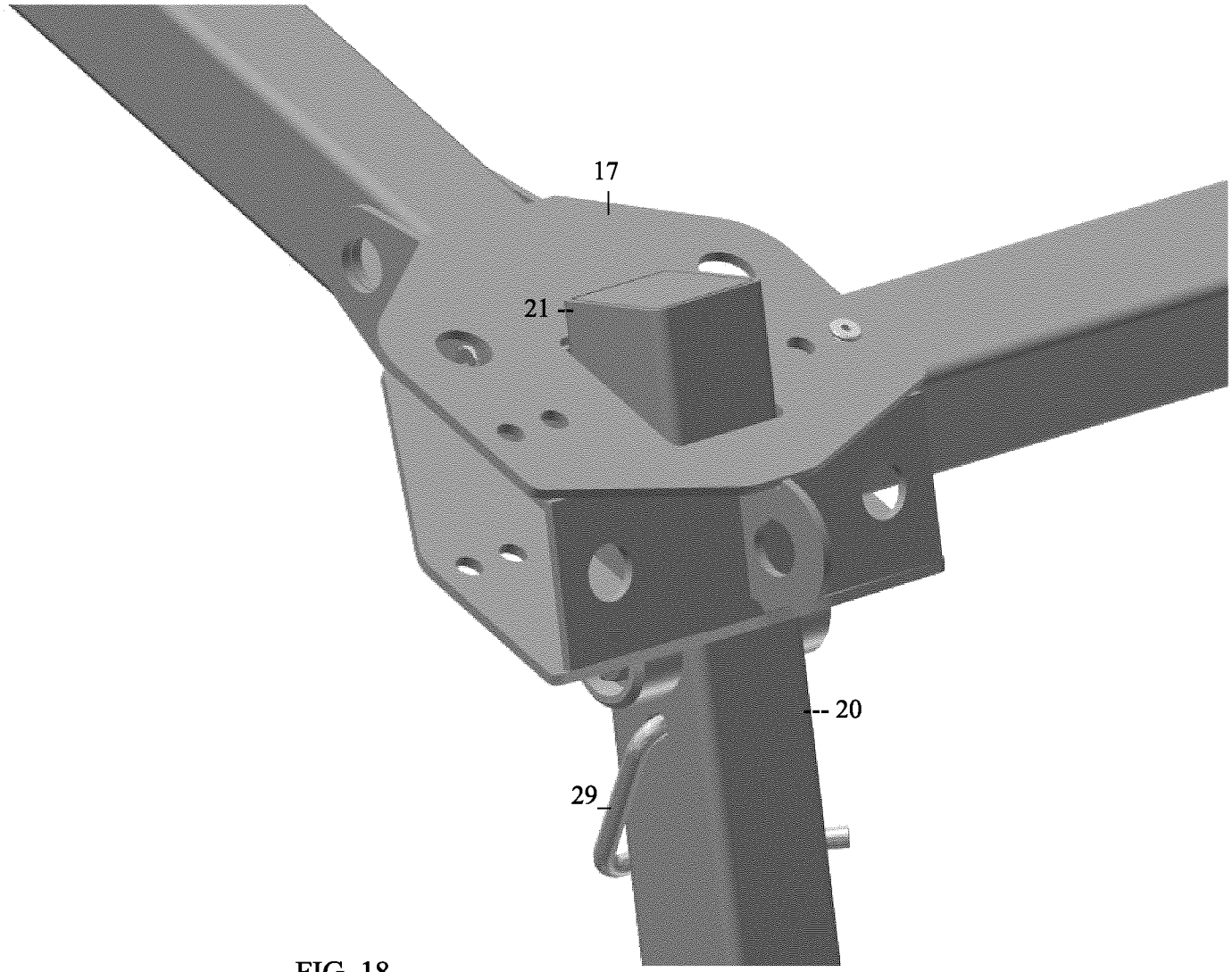
FIG. 18 is a detail front perspective view of the eave bracket of FIG. 16 with a leg inserted.

Purlin knee joints 28, and leg knee joints 30 operate in the same manner as the chord knee bracket 26 and the peak bracket 16 without the secondary lockout feature. Purlin knee bracket 28 is shown in FIG. 14. Purlin sections 60, 62 are hingedly connected about axis 64. When in the unfolded position shown in FIGS. 14 and 15, the purlin sections 60, 62 are locked in place by pins 66 which are mounted on interior sliding locking frame 68 and extend through slots 70 in the sides of the purlins, and into slots 72. Pins 66 are biased by spring 67 into the locked position shown in FIG. 14. Pulling on cable 69 slides locking frame 68, releasing pins 66 from slot 72 and allowing purlin sections 60, 62 to rotate.

Figure 19:
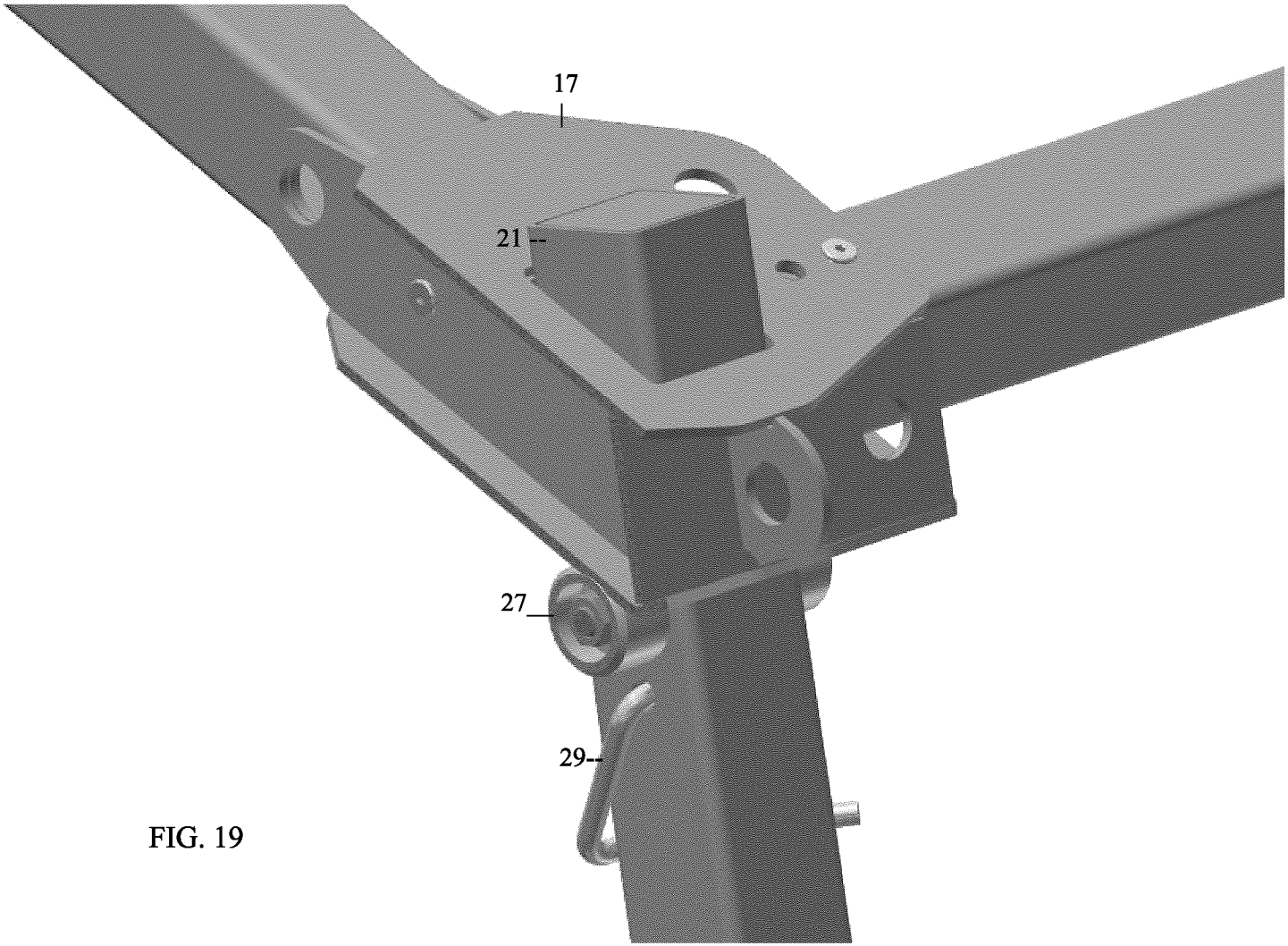
FIG. 19 is a detail front perspective view in partial cross-section of the eave bracket of FIG. 18 with leg inserted, shown resting in place on the upper leg bosses.
Figure 20B:
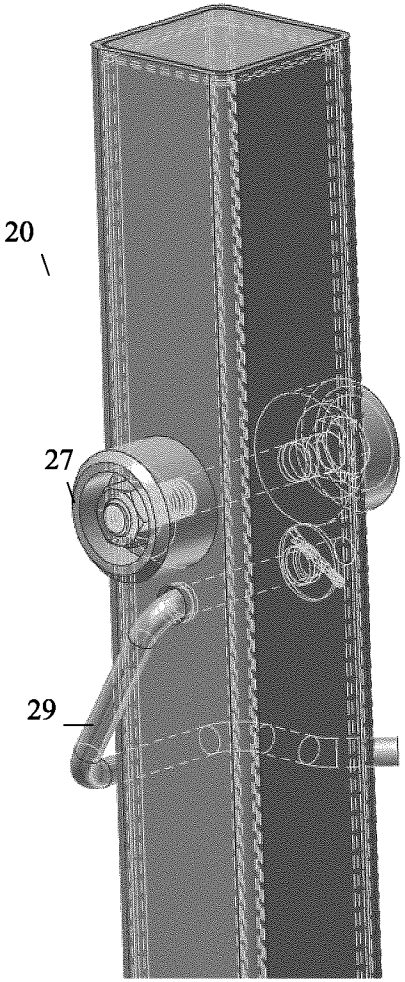
FIG. 20B is a detail front perspective view of a top portion of the leg assembly of FIG. 20A showing pinned bosses and a close haul wire hook for cover connection.
Figure 20A:
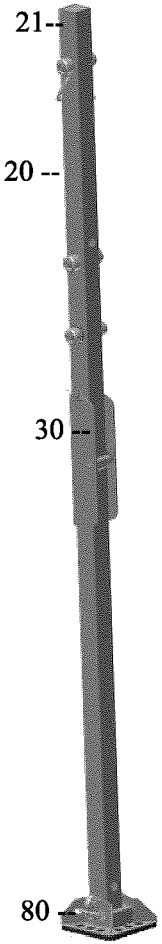
FIG. 20A is a detail front perspective view of a leg assembly.
Figure 21B:
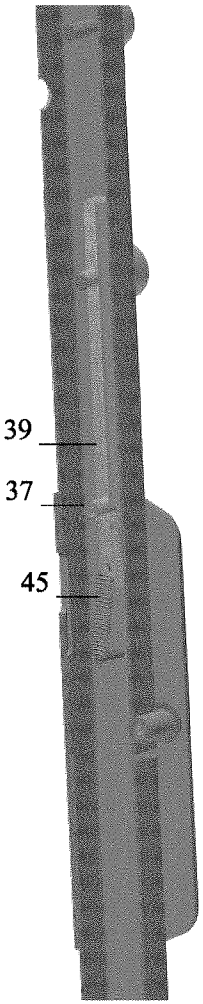
FIG. 21B is a detail front view of the leg knee joint of FIG. 21A partially in cross-section showing a locking slider.
Figure 21A:
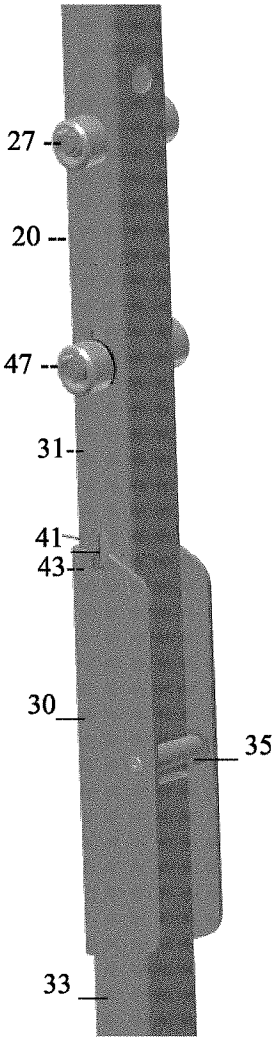
FIG. 21A is a detail front view of a leg knee joint.

Eave brackets 17 receive the upper end 21 of legs 20 through apertures 23. The lower surface 25 of bracket 17 rests on upper leg bosses 27 when the legs are in place. As shown in FIGS. 19 and 20B, leg 20 may be provided with close haul wire j-hook 29 for cover connection. As noted above, leg knee joints 30 operate in the same manner as the chord knee bracket 26 and the peak bracket 16 without the secondary lockout feature. Leg knee joint 30 is shown in FIGS. 21A and 21B. Leg sections 31, 33 are hingedly connected about axis 35. When in the unfolded position shown in FIGS. 21A and 21B, leg sections 31, 33 are locked in place by pins 37 which are mounted on interior sliding locking frame 39 and extend through slots 41 in the sides of the legs 20, and into slots 43. Pins 37 are biased by spring 45 into the locked position shown in FIG. 21A. Pulling on boss 47 slides locking frame 39, releasing pins 37 from slot 43 and allowing leg sections 31, 33 to rotate. This lock mechanism allows for a two-handed grip when lowering the shelter.

Figure 22:
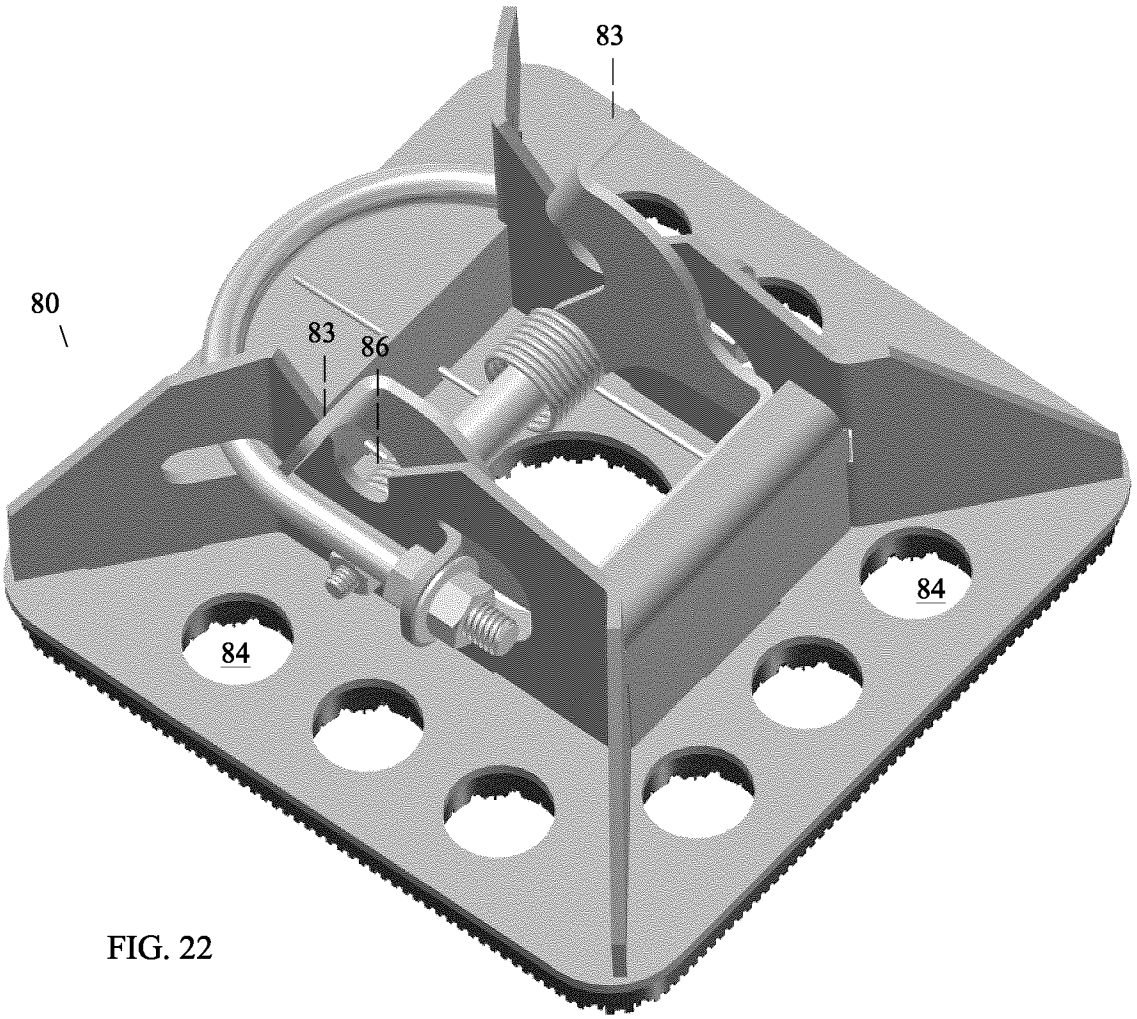
FIGS. 22 and 23 are perspective detail views of a quick release foot assembly.
Figure 23:
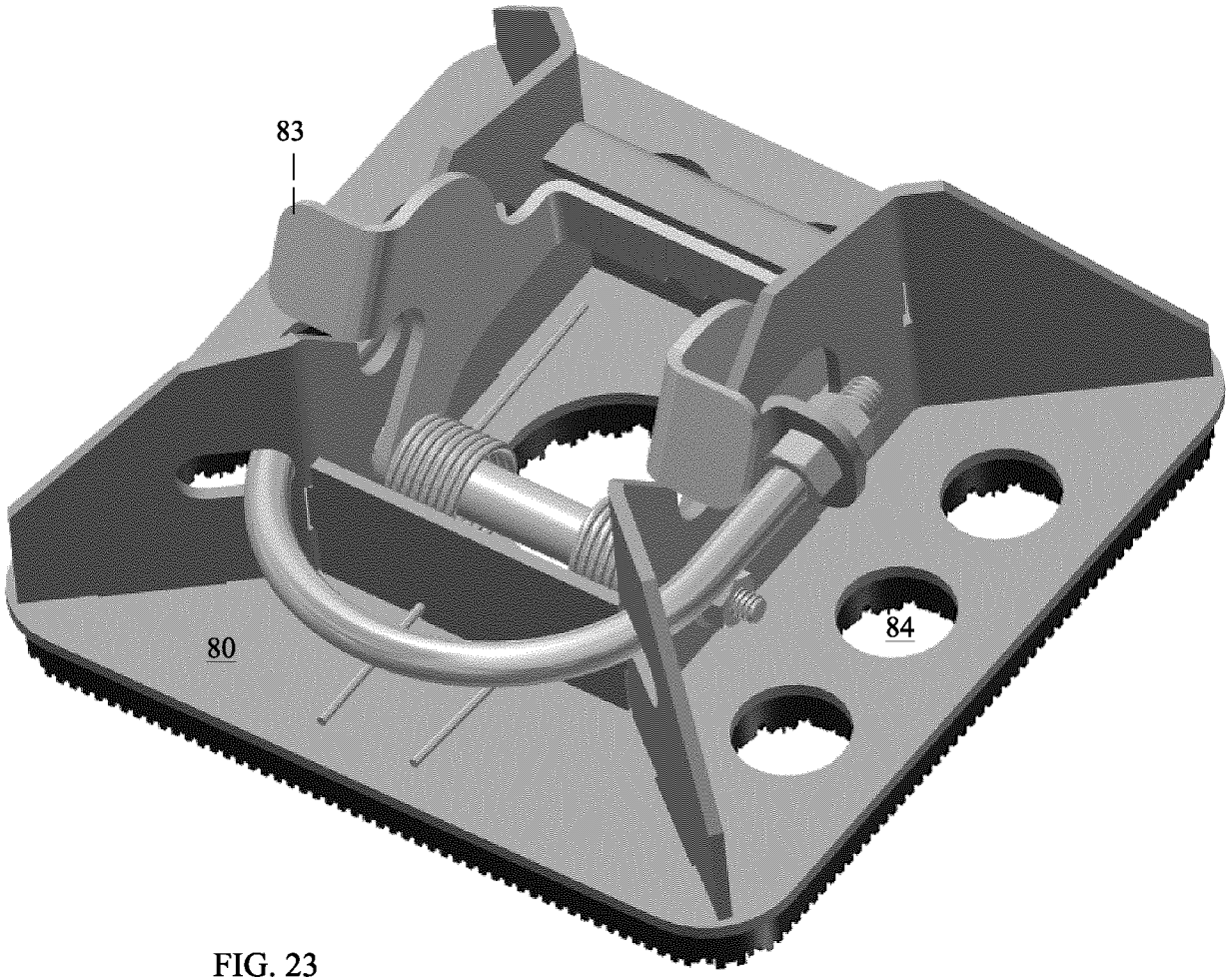

FIGS. 22 and 23 show a quick release foot assembly 80 for attachment to legs 20. Such quick release feet allow a high wind set up and tear down procedure, where the feet 80 are removed from the legs 20 before setup, attached to the shelter's floor and securely anchored to the ground through apertures 84. When the frame is erected, horizontal cylindrical extensions (not shown) on the legs 20 snap into slots 86 in the pre-anchored feet 80 to be held in place by spring-biased hinged arms 83, greatly reducing the risk of injury to personnel or damage to equipment. High wind take down is the opposite of set up, where the shelter feet can be released from the leg assembly by using a foot to force open arms 83, which allows a steady two-handed grasp on the leg at all times. Foot pads 80 are also sized to allow a low enough ground pressure, even with a snow loaded shelter, such that any ground capable of supporting a walking individual, or a vehicle driving on normal tires, is sufficient to support the shelter.

Figure 24:
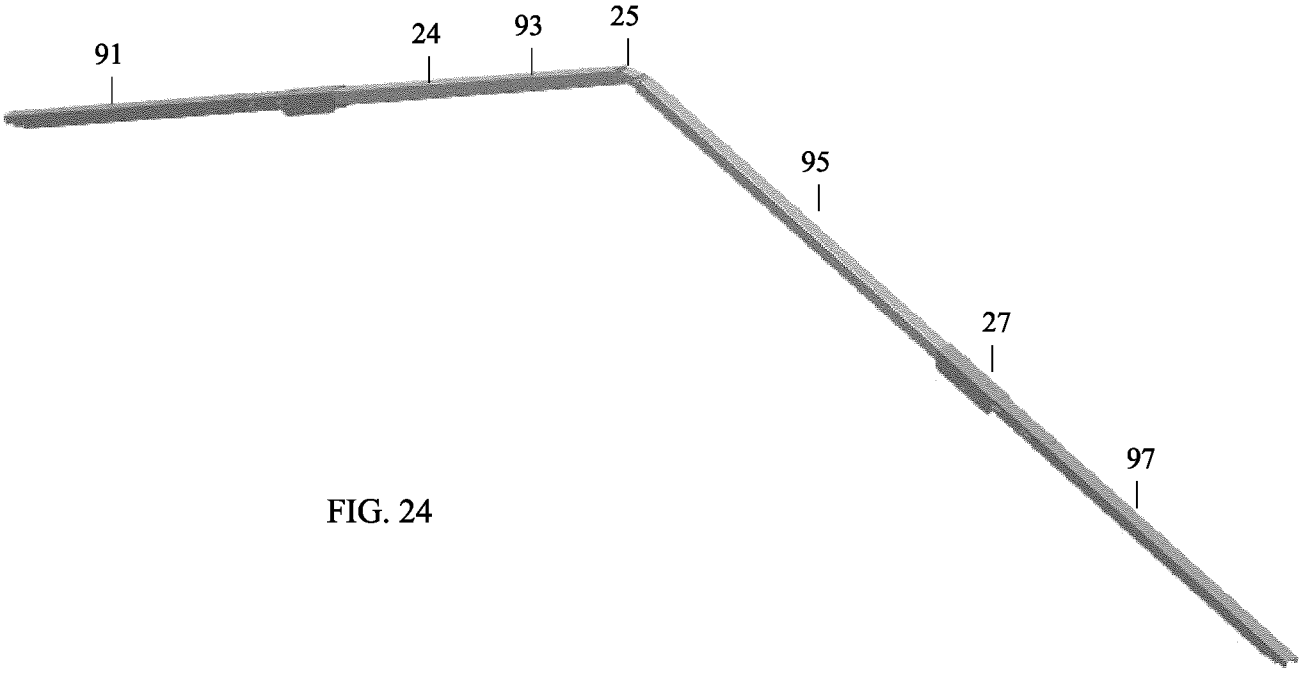
FIG. 24 is a perspective view of the midspan chord.
Figure 25:
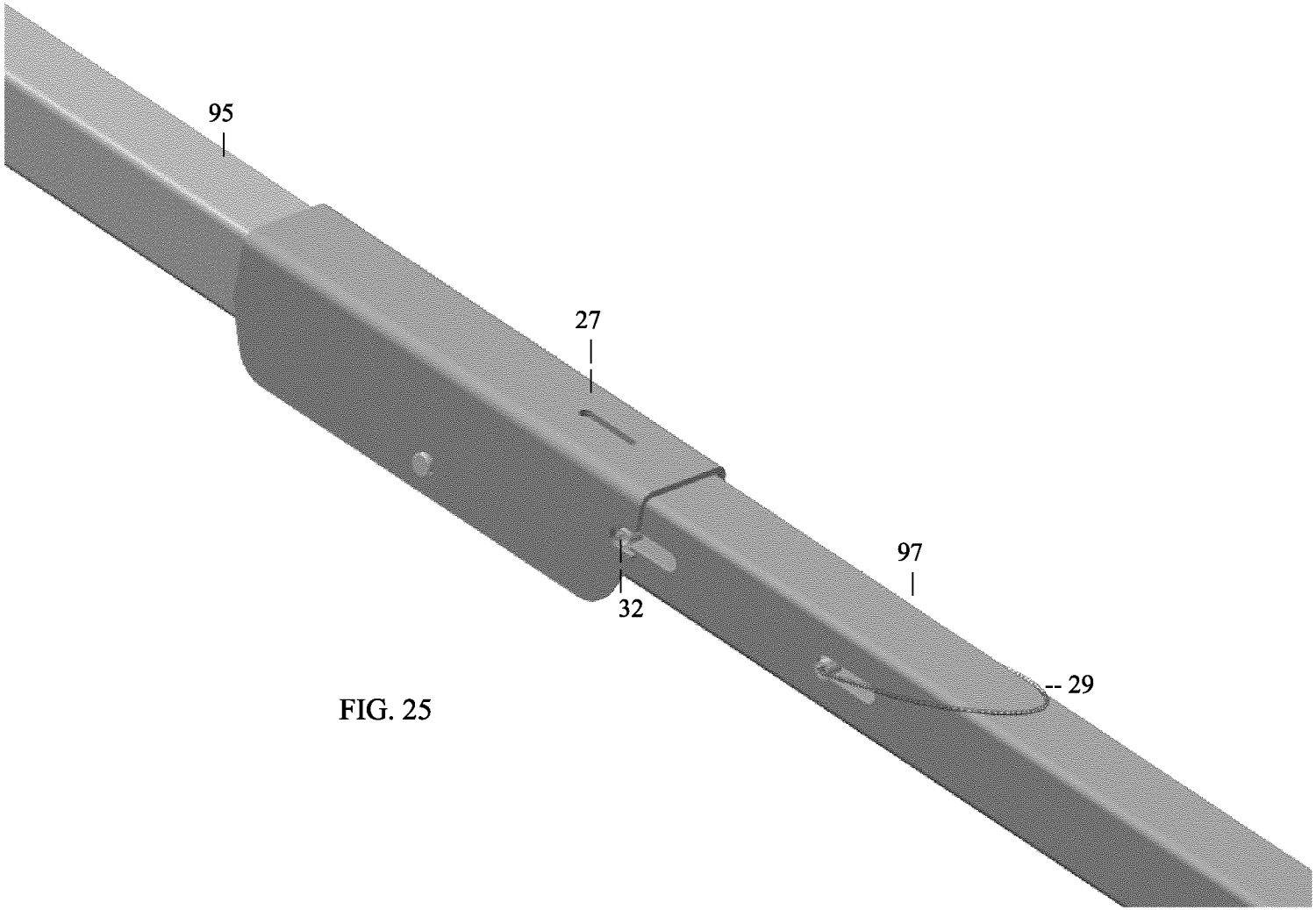
FIG. 25 is a detail perspective view of the midspan chord knee joint.
Figure 26:
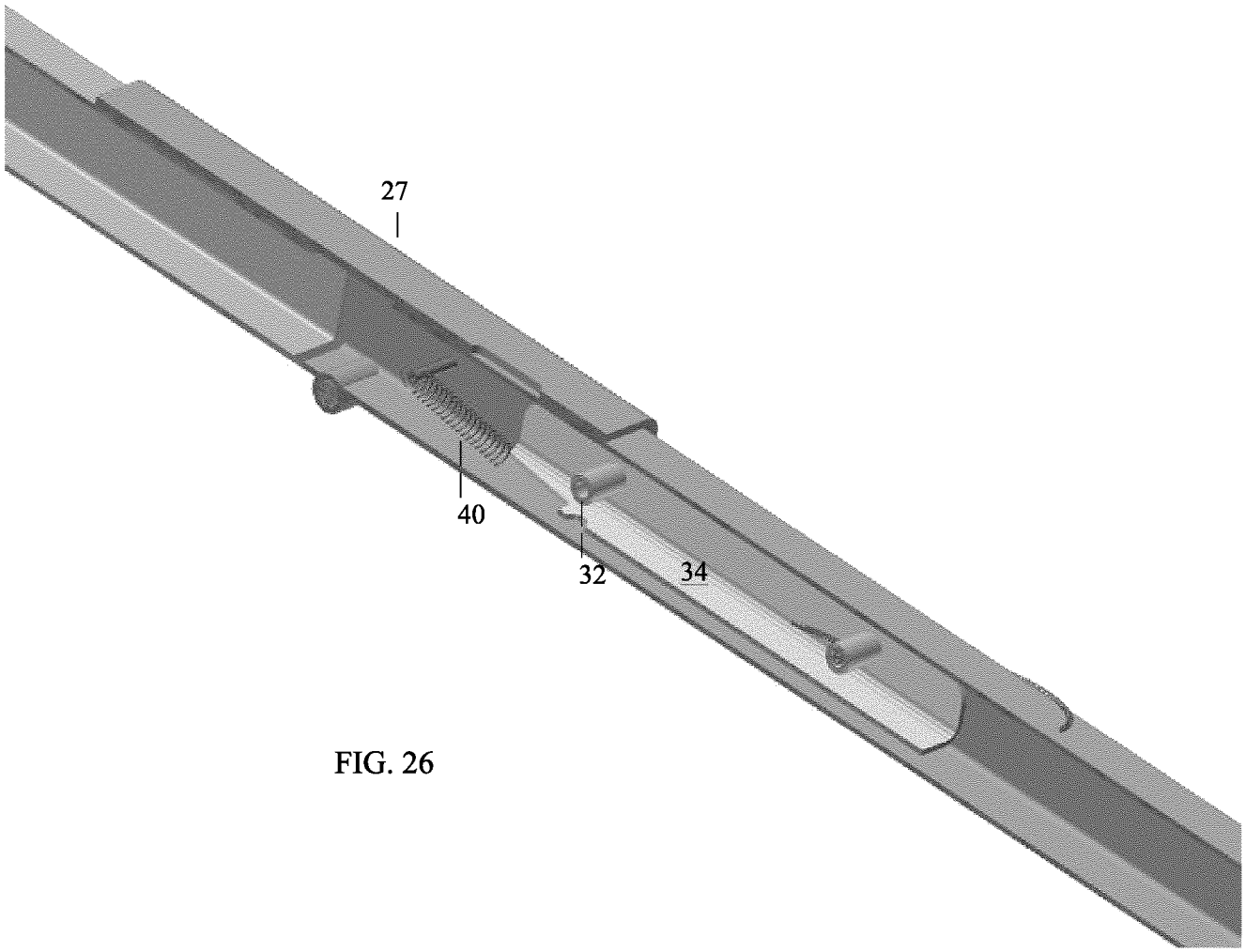
FIG. 26 is a detail perspective view partially in cross-section showing the midspan chord knee joint with lock slider.
Figure 27:
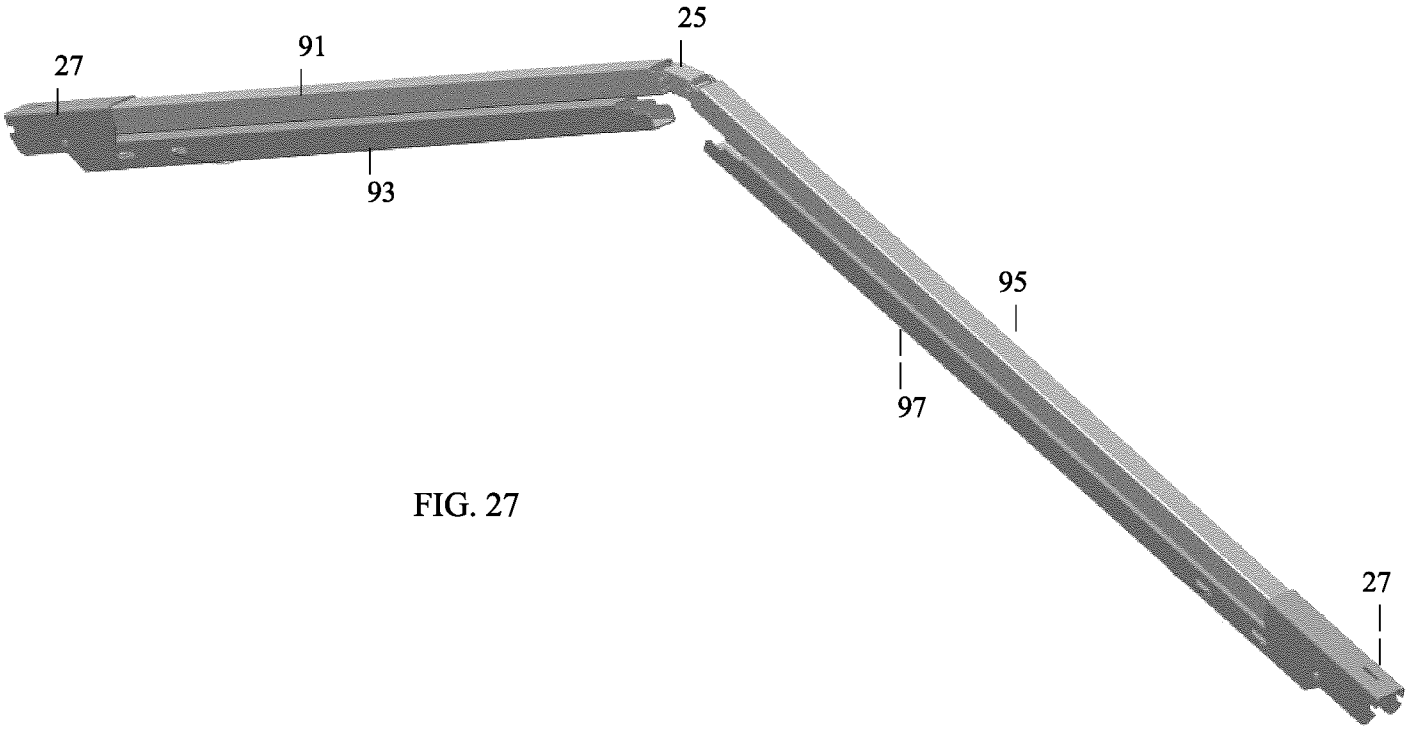
FIG. 27 is a perspective view of the midspan chord partially folded.
Figure 28:
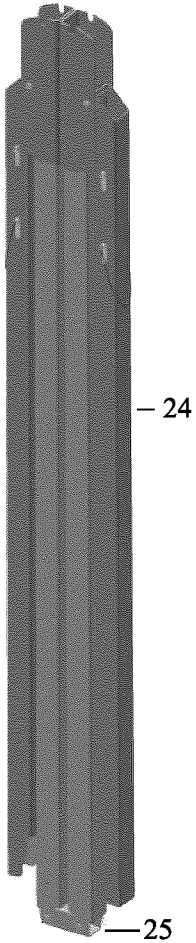
FIG. 28 is a perspective view of the midspan chord fully folded.
Figure 29:
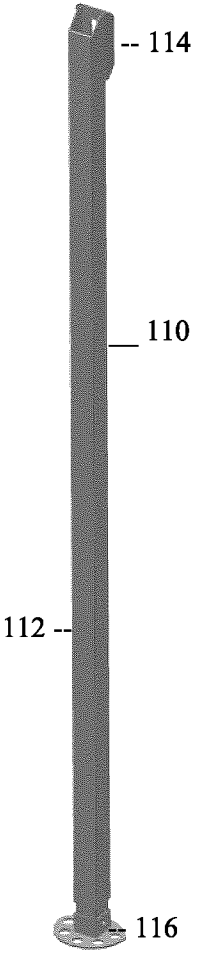
FIG. 29 is a perspective view of a telescoping wind kit post.
Figure 30:
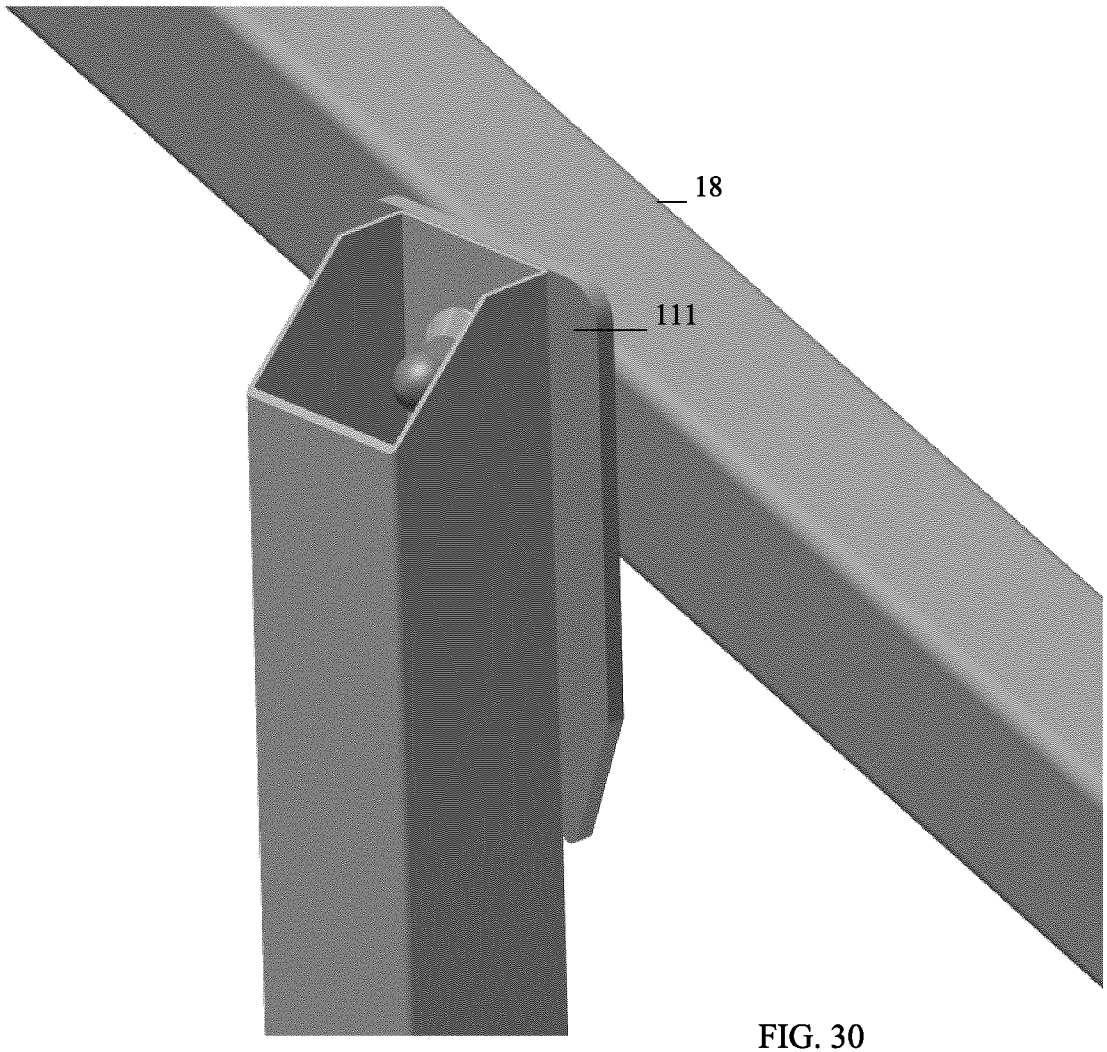
FIG. 30 is a detail perspective view of the wind kit post connection.
Figure 31:
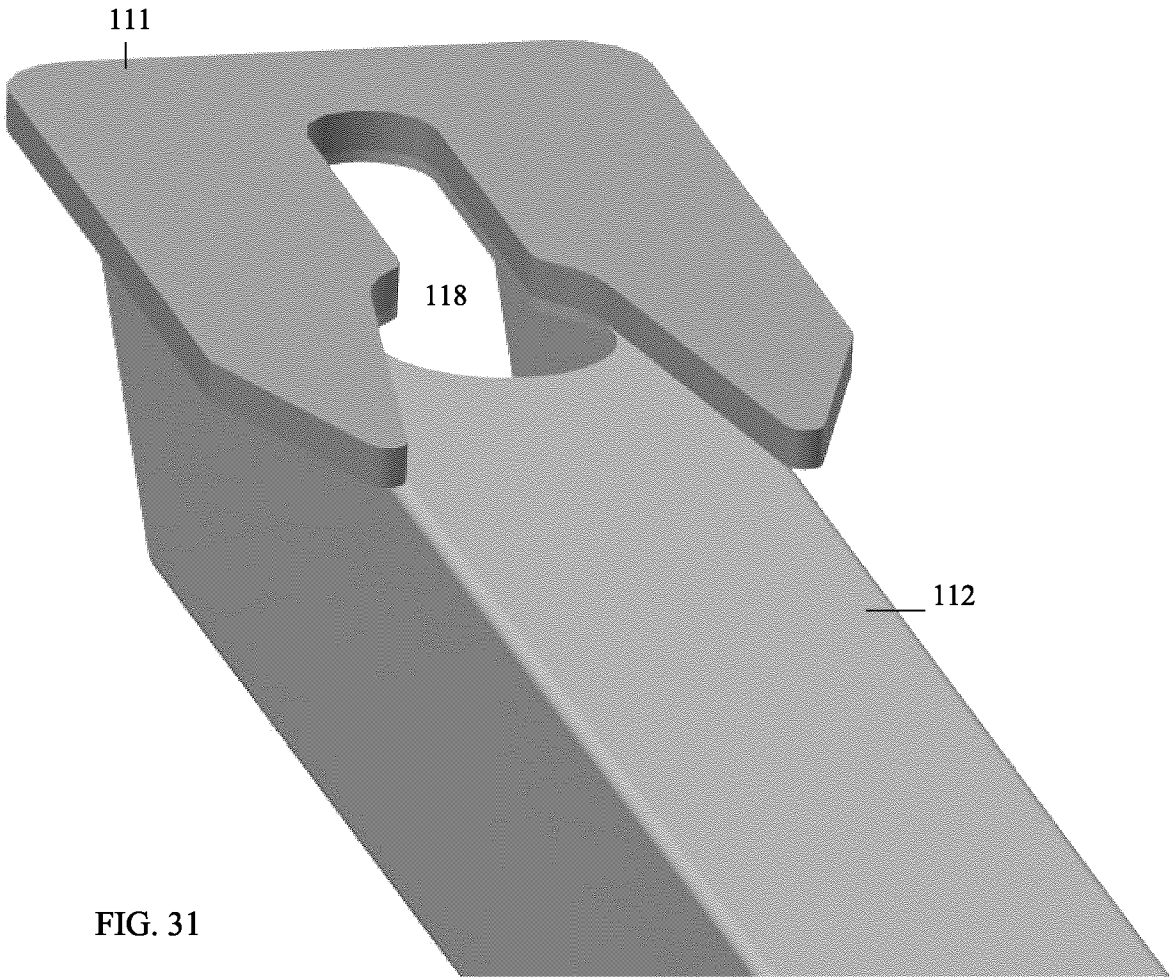
FIG. 31 is an isolated detail perspective view of the connecting bracket of the wind kit post.
Figure 32:
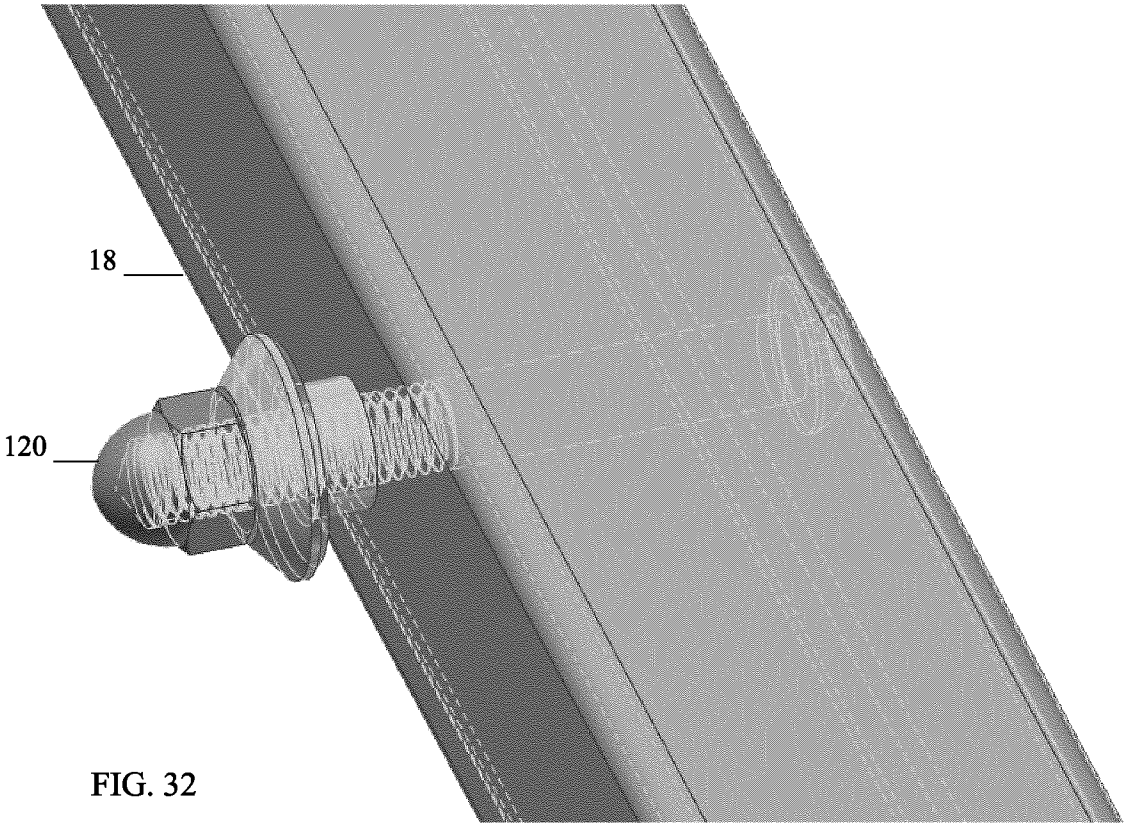
FIG. 32 is an isolated detail perspective view of the connecting fastener on the chord for the wind kit post.
Figure 33:
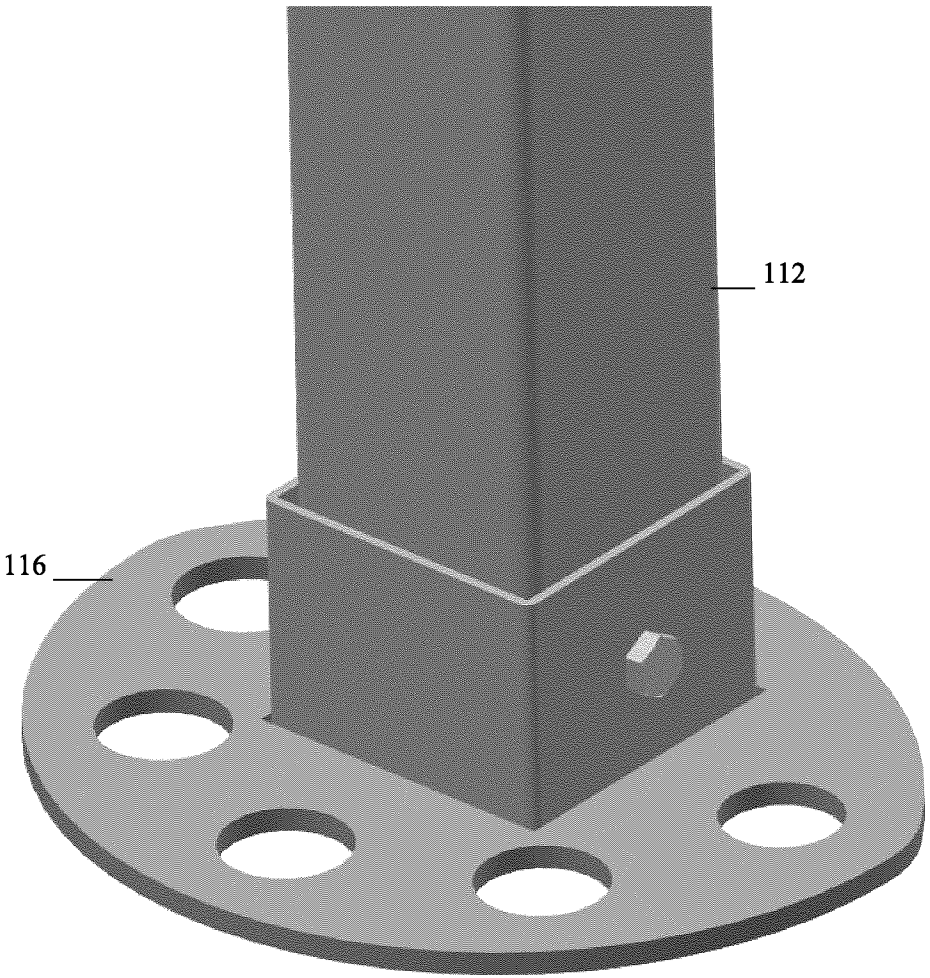
FIG. 33 is a detail perspective view of the wind kit foot.

Midspan chords 24 are shown in FIG. 24 through 28. Each chord 24 comprises a single folding element which, when unfolded as shown in FIG. 24, rests on upper frame assembly 12, with its central hinge 25 on peak purlin bracket 28 and its ends on lower purlin brackets 28. The midspan chord knee joints 27 fold and lock/unlock the chord sections 91, 93, 95, 97 in the same manner as the purlin knee joints 28, using cable 29 to unlock the joint.

A telescoping wind kit post 110 is illustrated in FIG. 29 through 33. Such posts can be attached to chords 18 at either end of the frame 10, in order to assist in securing the cover to the structure, as follows. Each post 110 has a telescoping vertical post 112, the interior telescopic section being secured at its lower end to wind kit post foot 116. At its upper end the post 112 is provided with a bracket 113 having a keyhole slot 118 which engages a bolt 120 on chord 18.

As shown in FIGS. 34 and 35, the size of the modular structure can be increased by increasing the number of chords 18, purlins 14 and peak brackets 16 in the upper frame assembly 12, with proportionate increase in the number of legs 20 and midspan chords 24. The resulting structure may thereby accommodate a two or four bays for equipment storage.

Figure 36:
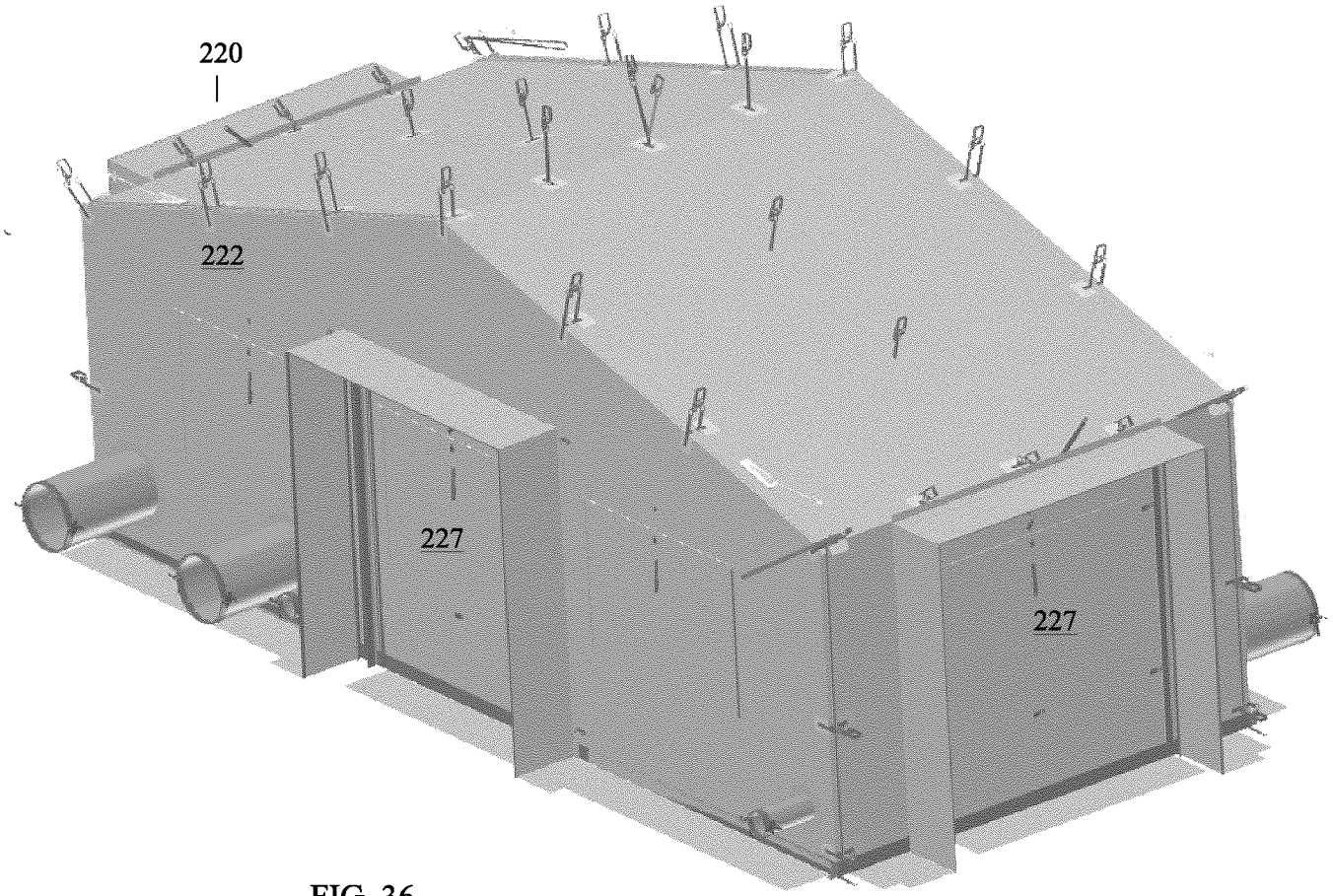
FIG. 36 is a perspective view of a completed cover for a one bay structure.
Figure 37:
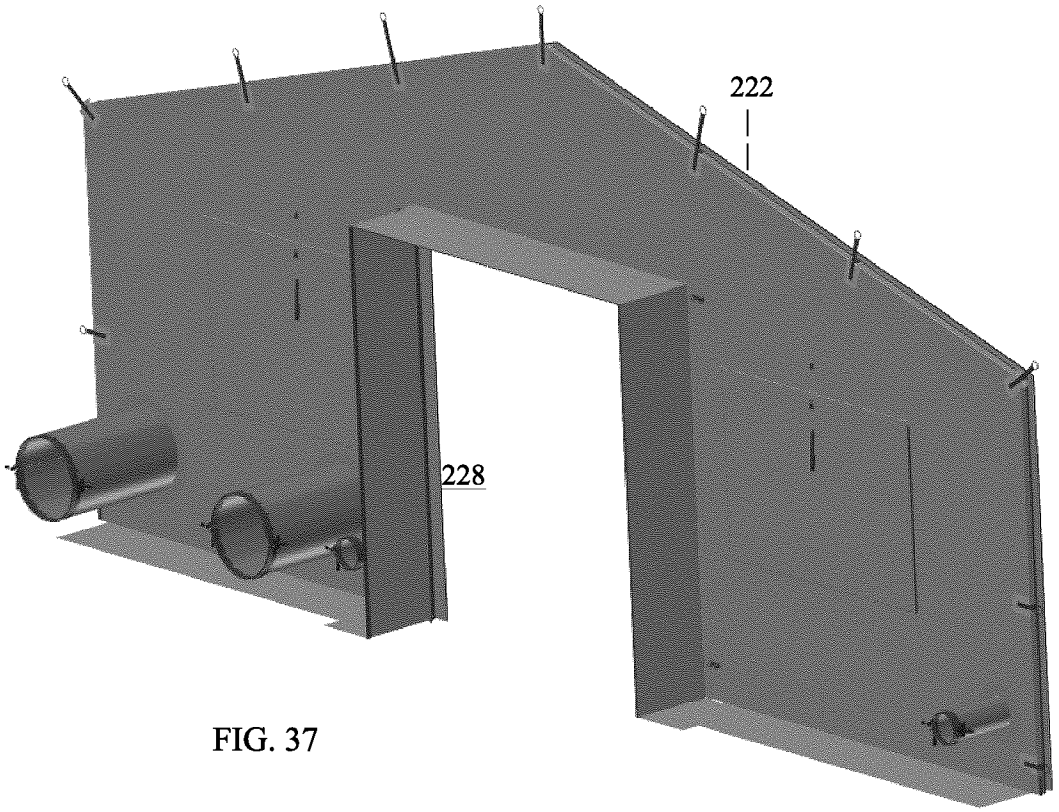
FIG. 37 is a detail perspective view of one endwall for the cover shown in FIG. 36.
Figure 38:
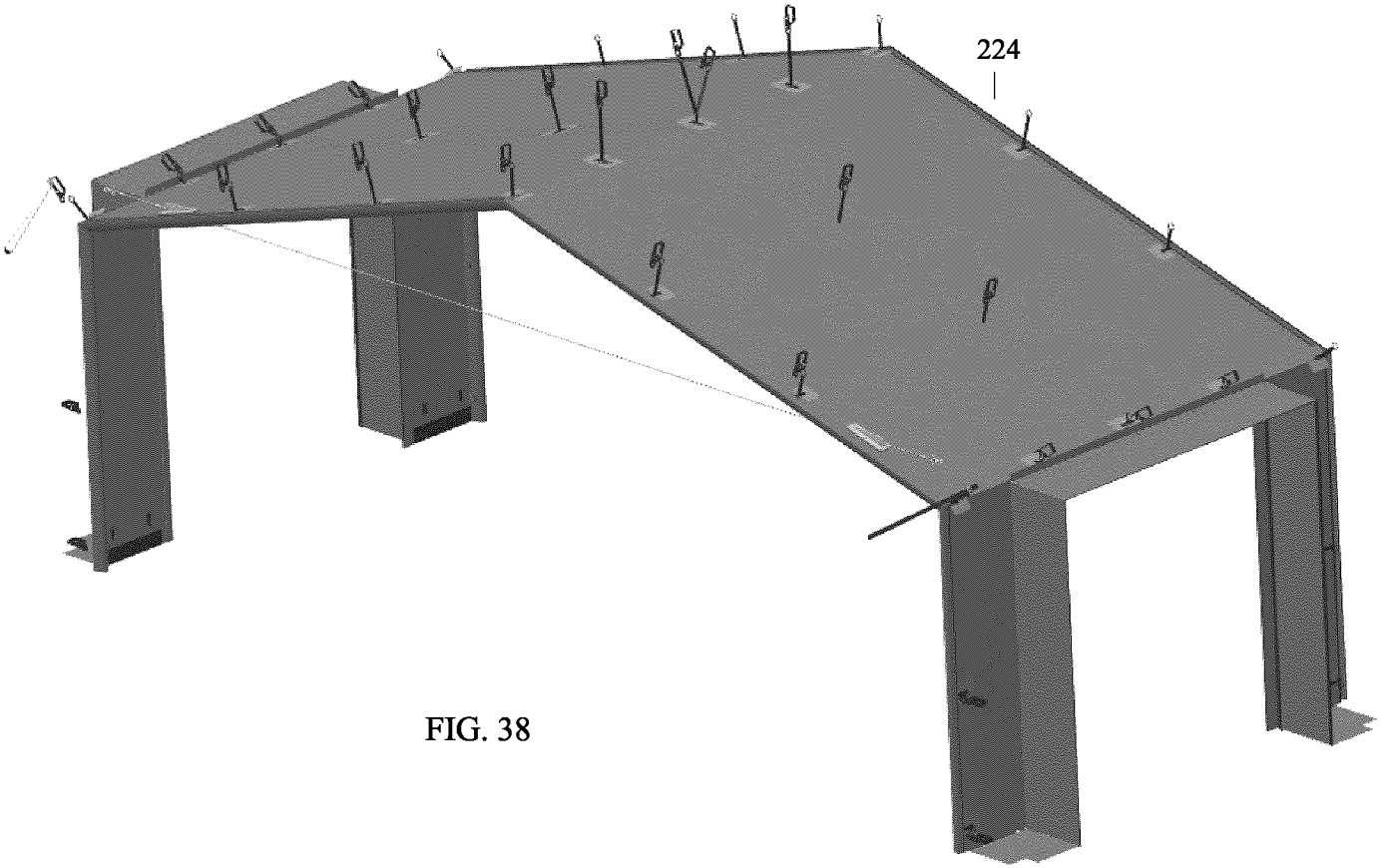
FIG. 38 is a detail perspective view of the barrel section for the cover shown in FIG. 36.
Figure 39:
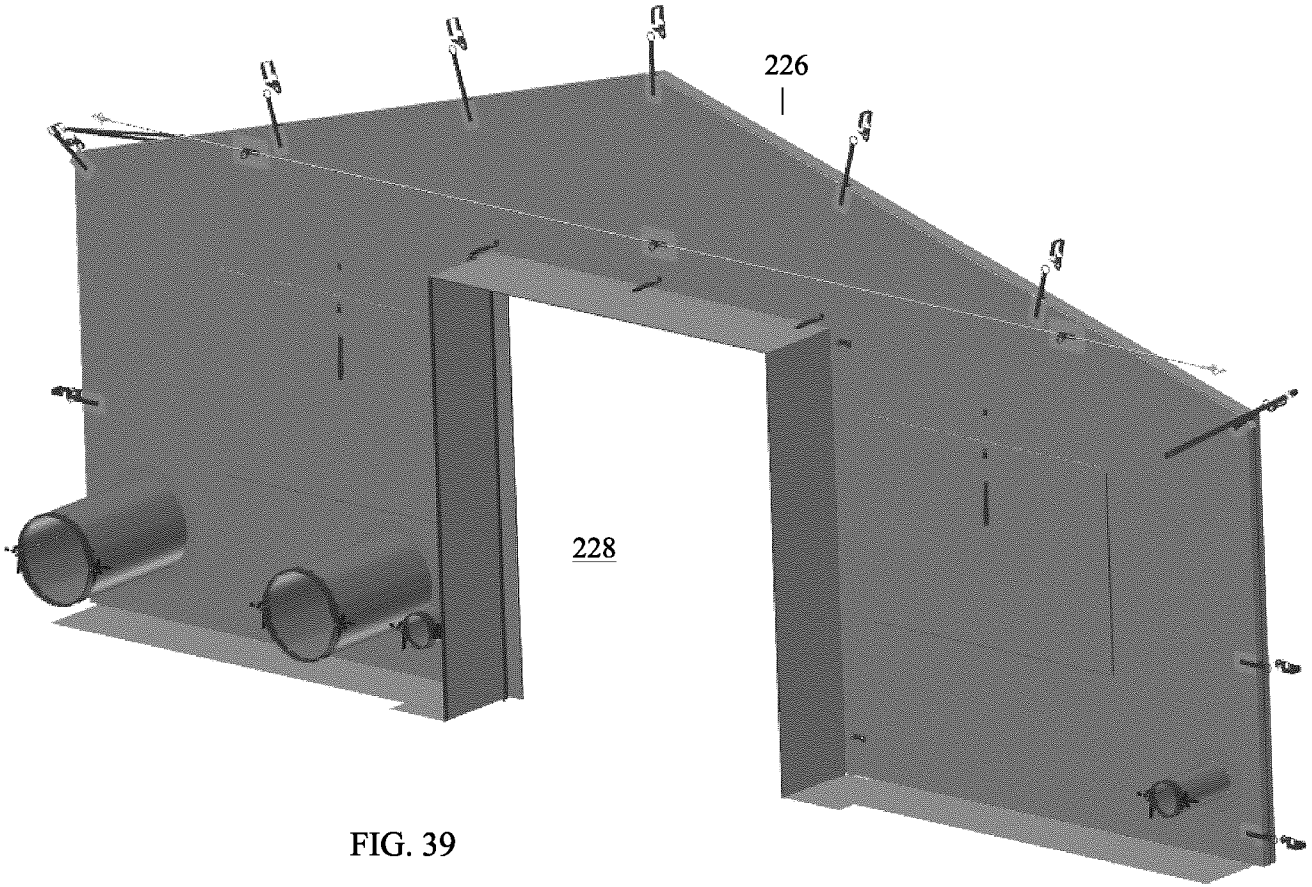
FIG. 39 is a detail perspective view of the second endwall for the cover shown in FIG. 36.
Figure 40:
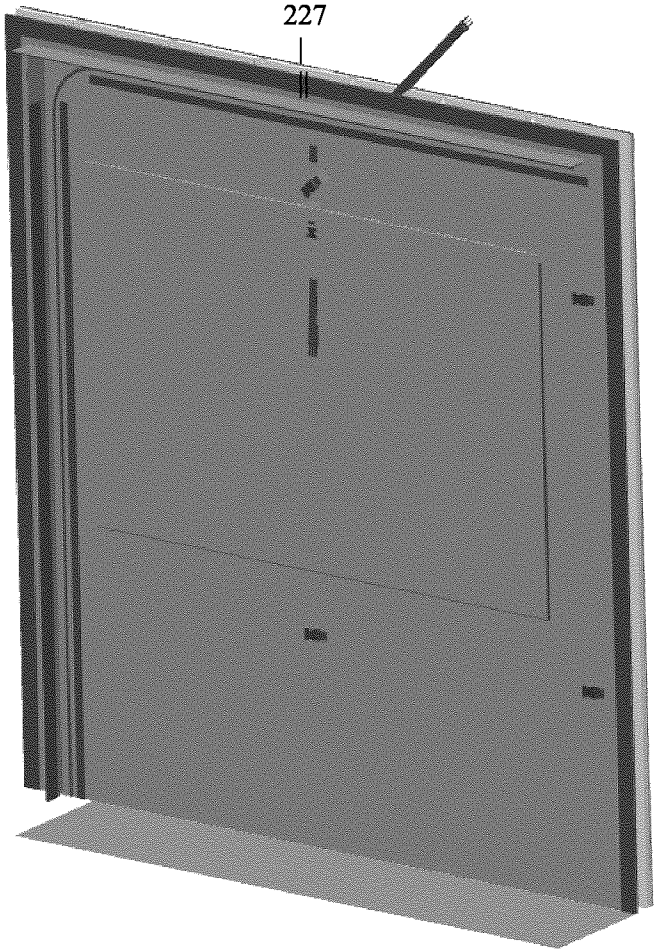
FIG. 40 is a detail perspective view of the exterior of a soft door assembly for the cover shown in FIG. 36.
Figure 41:
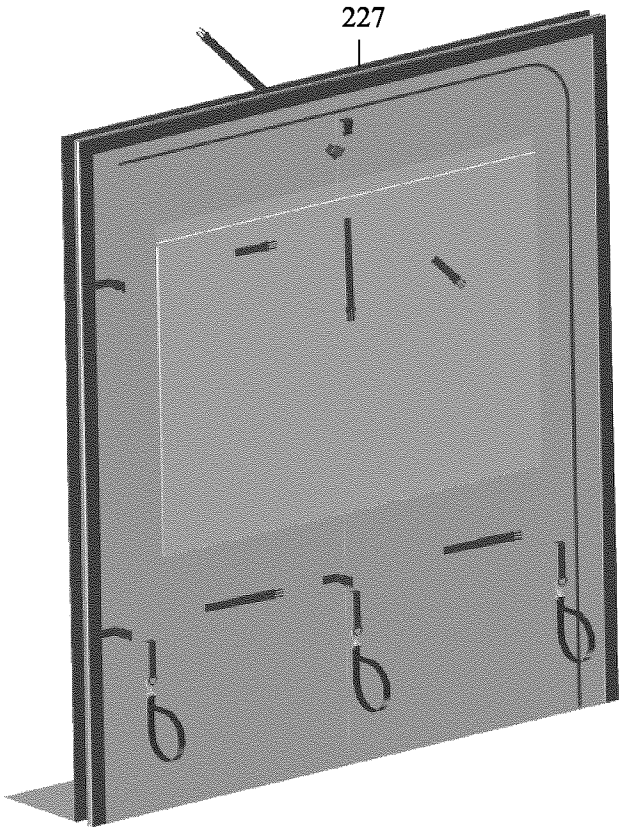
FIG. 41 is detail perspective view of the interior of the soft door assembly for the cover shown in FIG. 36.
Figure 42:
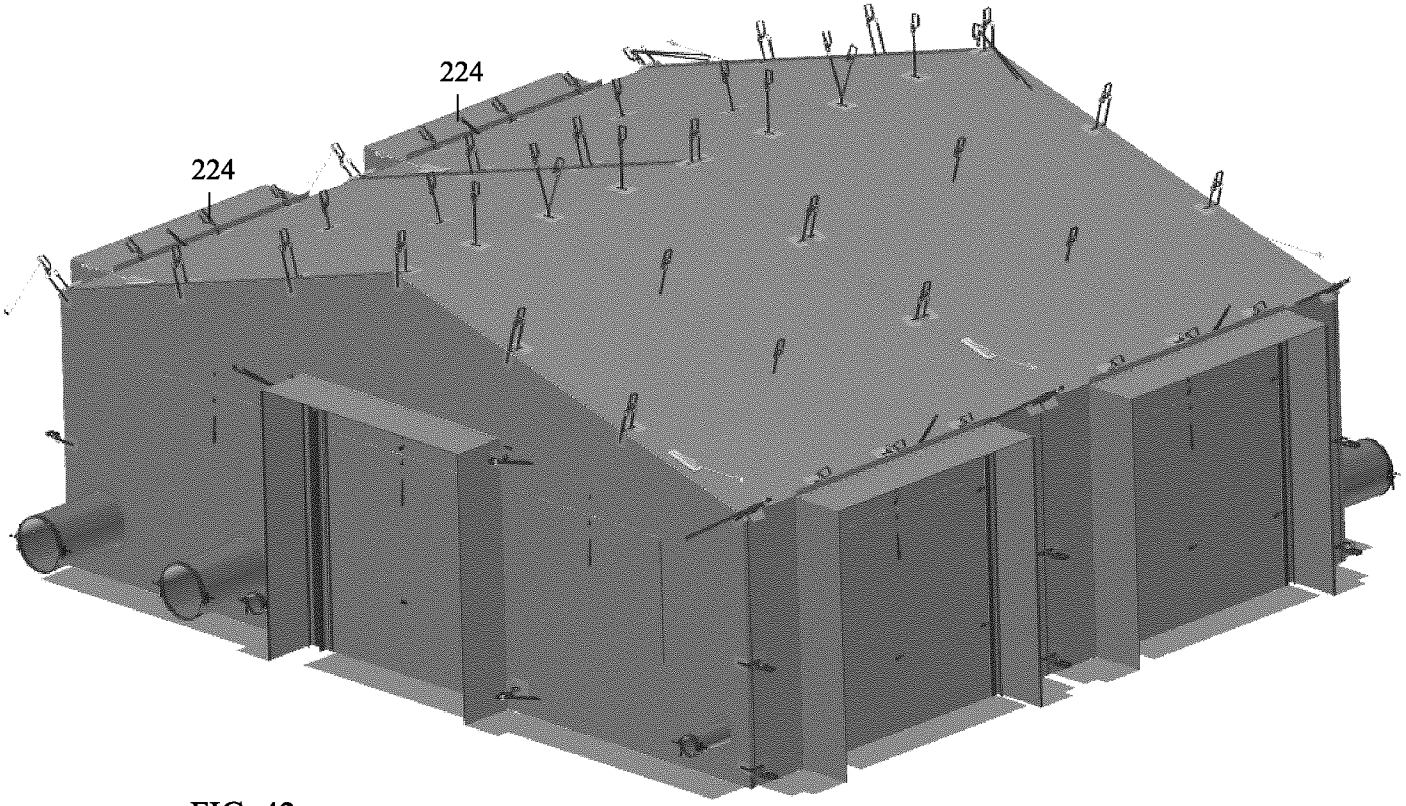
FIG. 42 is a perspective view of a completed cover for a two bay structure.
Figure 43:
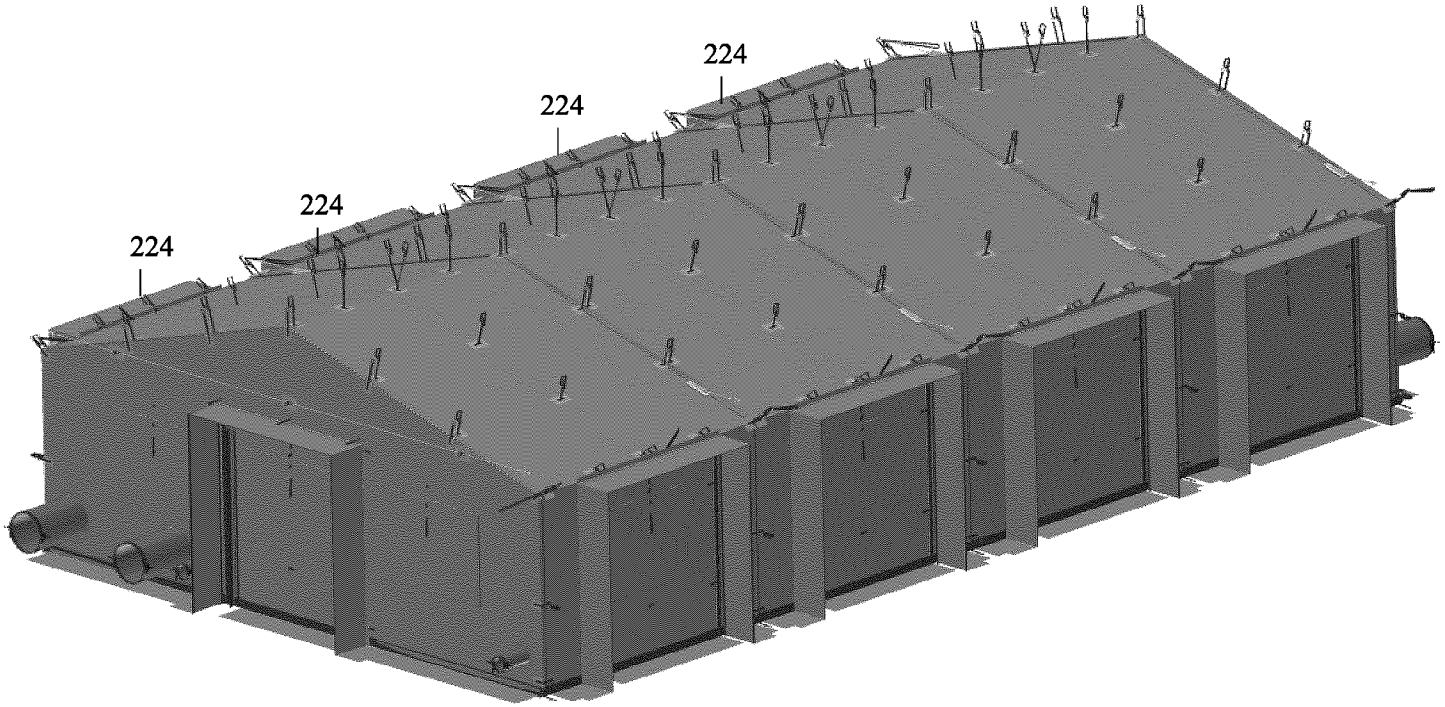
FIG. 43 is a perspective view of a completed cover for a four bay structure.

FIG. 36 illustrates a completed fabric cover 220 for the one bay structure whose frame 10 is shown in FIG. 1. It includes an endwall 222 shown in FIG. 37, a barrel section 224 shown in FIG. 38, and a second endwall 226 shown in FIG. 39. A soft door assembly 227 may be used for doors 228, whose exterior is shown in FIG. 40 and interior in FIG. 41. For the two bay structure shown in FIG. 42, two barrel sections 224 are used and four are used for the four bay structure shown in FIG. 43.

Figure 44:
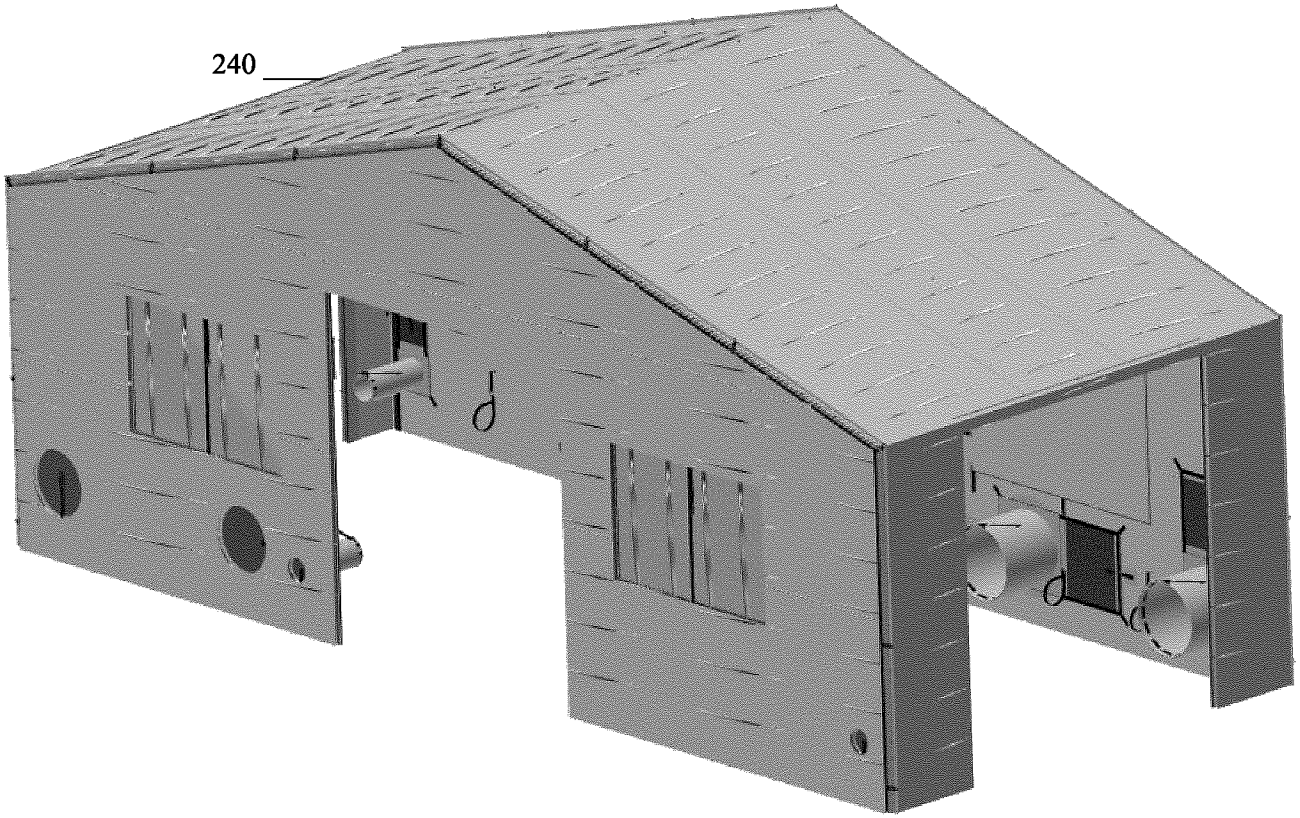
FIG. 44 is a perspective view of a removable insulation package for a single bay structure.
Figure 45:
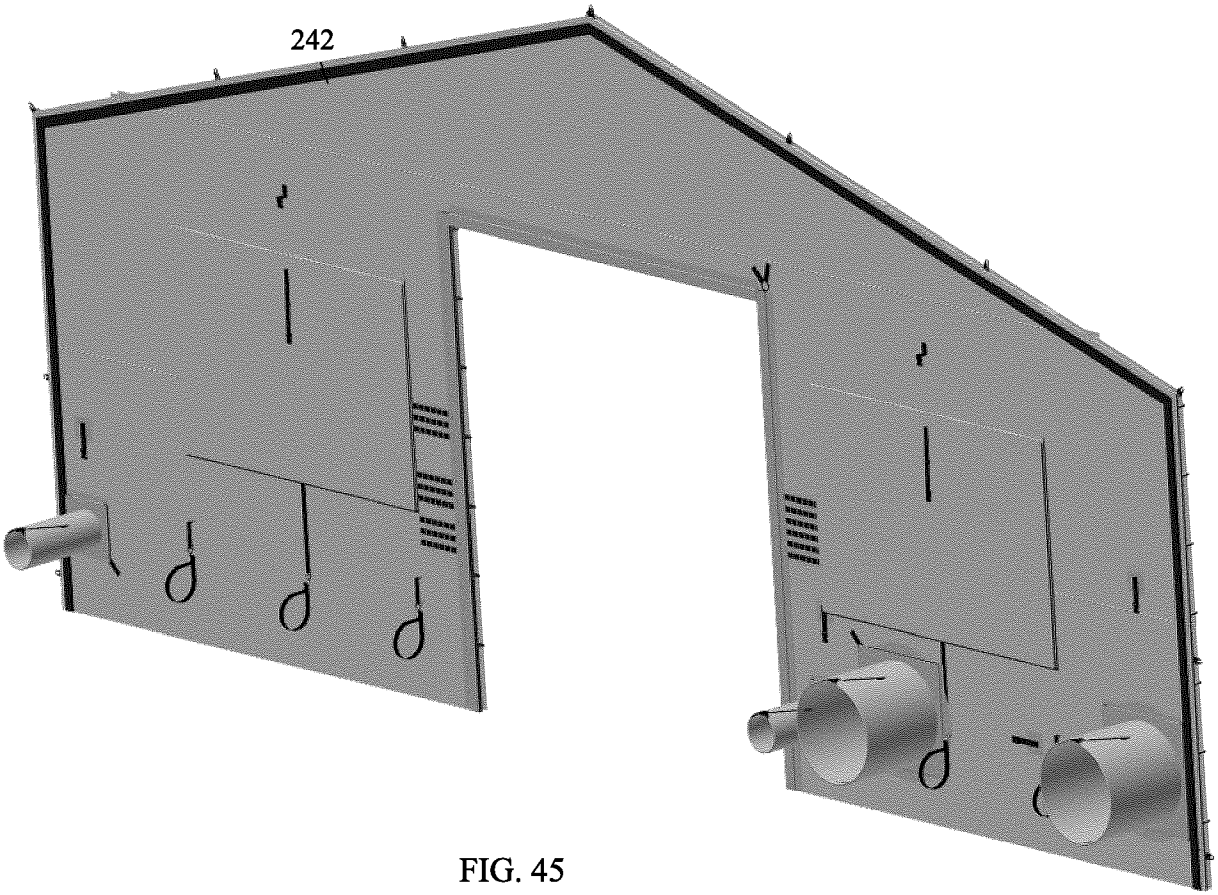
FIG. 45 is a perspective view of the endwall for the removable insulation package shown in FIG. 44, both endwalls being the same.
Figure 46:
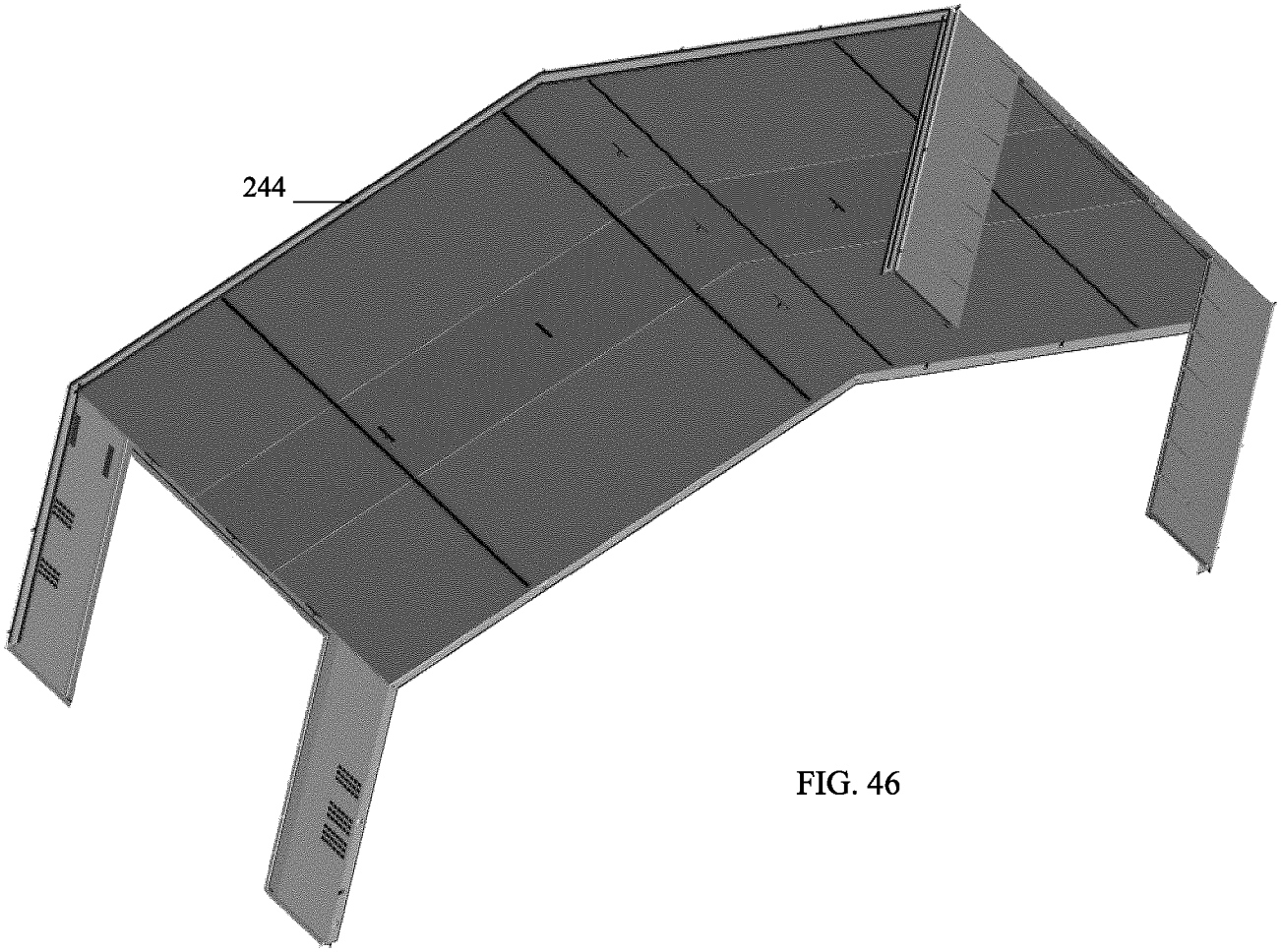
FIG. 46 is a perspective view of the barrel for the removable insulation package shown in FIG. 44.
Figure 47:
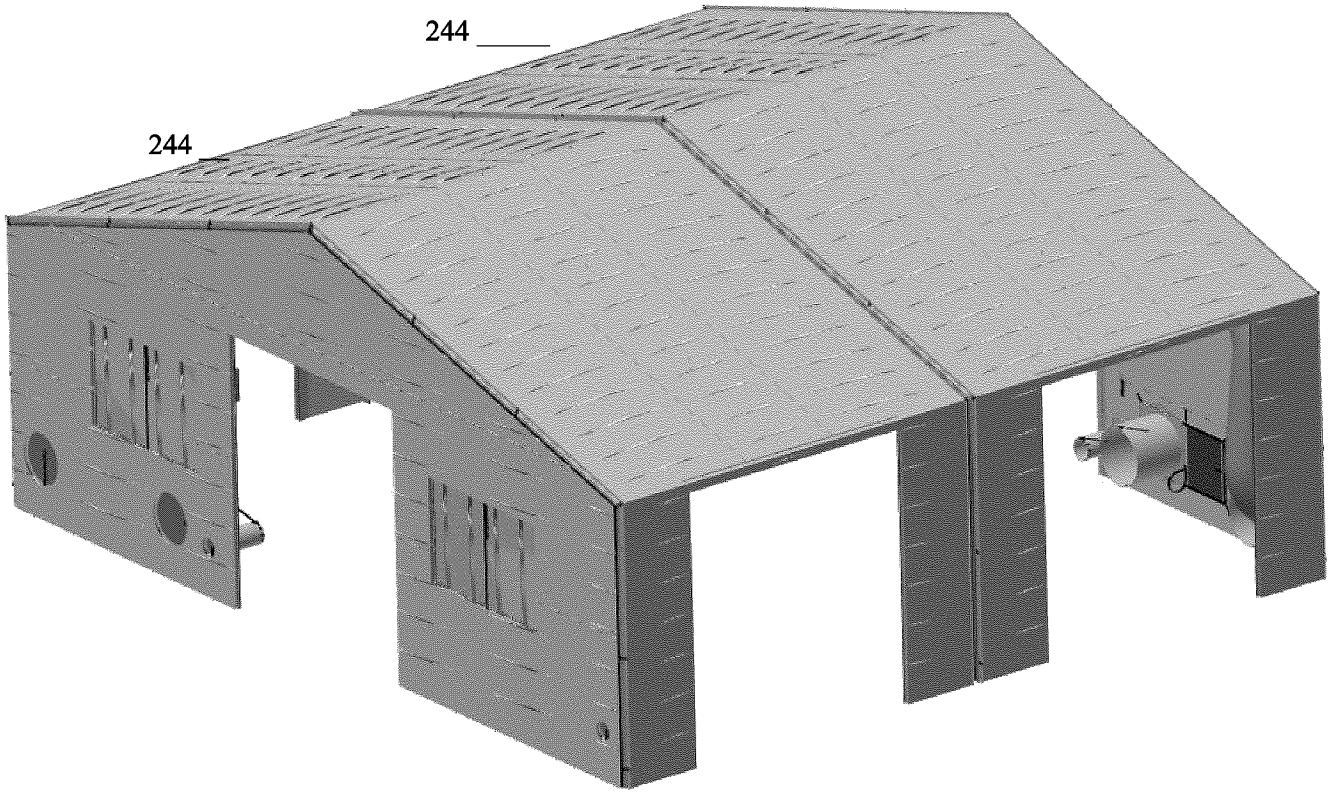
FIG. 47 is a perspective view of the removable insulation package for a two bay structure.
Figure 48:
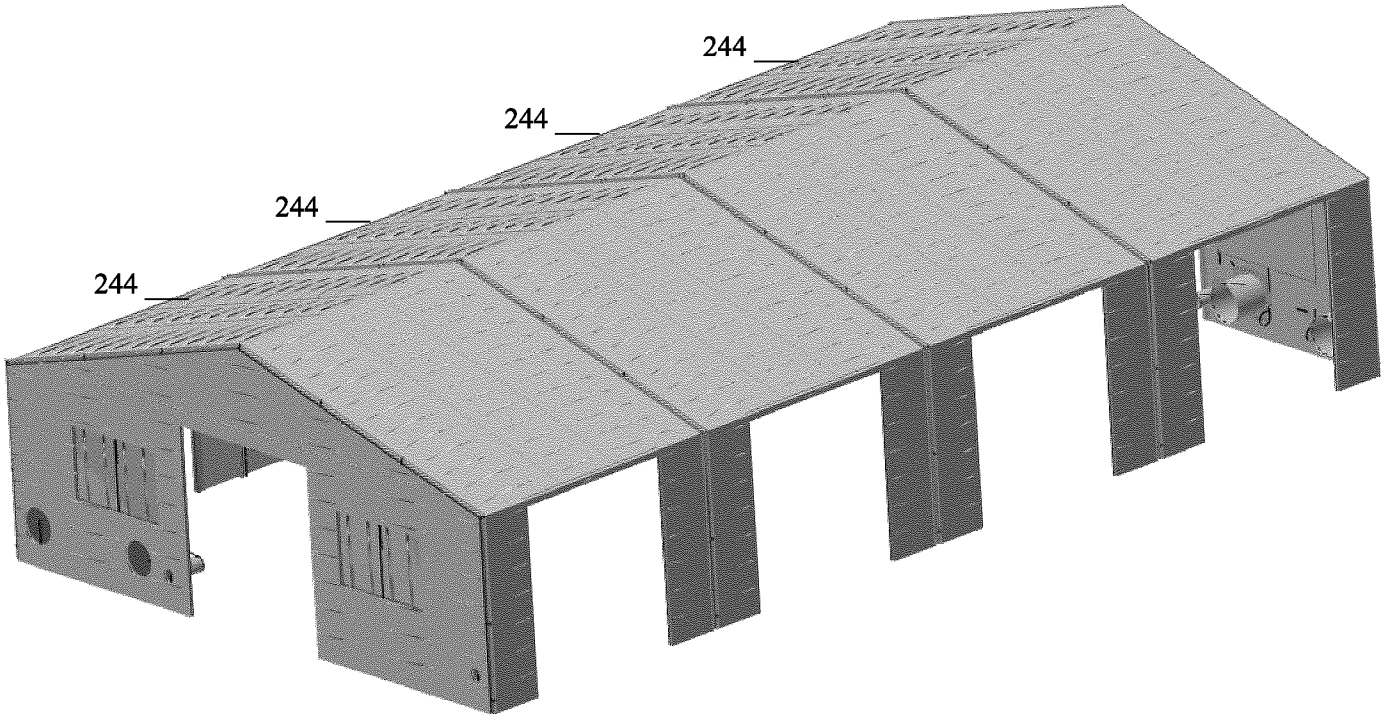
FIG. 48 is a perspective view of the removable insulation package for a four bay structure.

Insulation 240 can be added to the structure as shown in FIG. 44 for a single bay structure. It comprises two insulation endwalls 242 for the removable insulation package shown in FIG. 45, both endwalls being the same. The barrel 244 for the removable insulation package is shown in FIG. 46. Again for the two bay structure as shown in FIG. 47, two barrel sections 244 are used and four are used for the four bay structure shown in FIG. 48.

Figure 49:
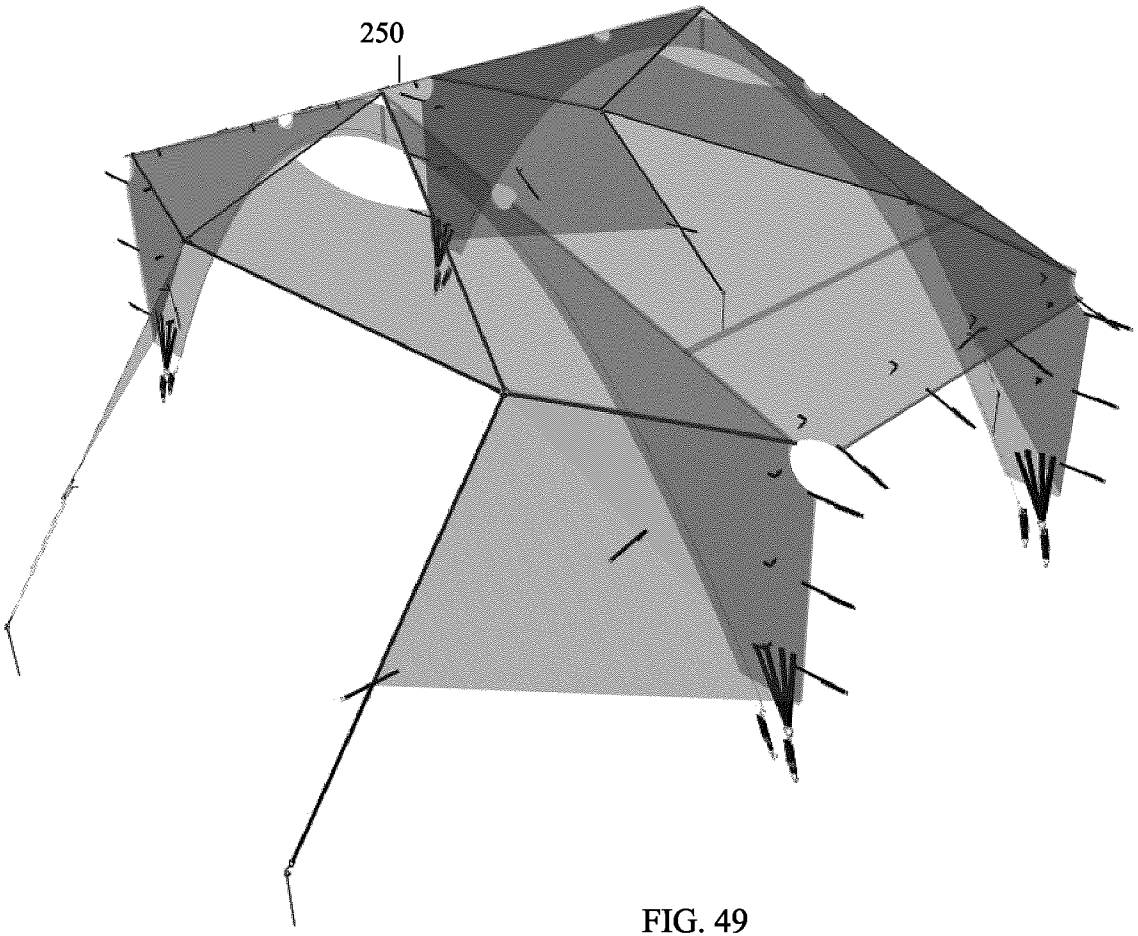
FIG. 49 is a perspective view of a solar shade for use with the shelter shown in FIG. 36.
Figure 50:
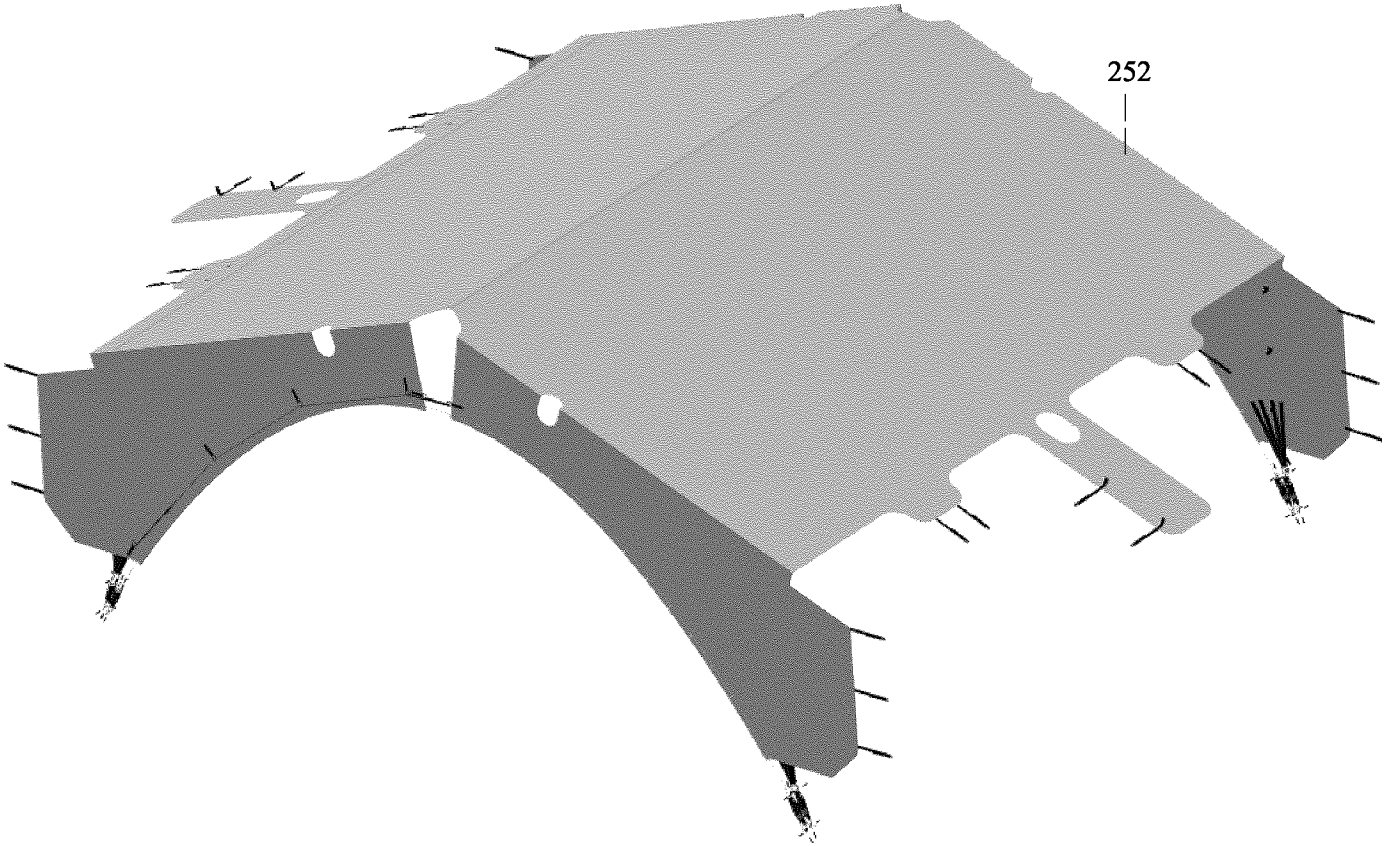
FIG. 50 is a perspective view of a winter fly for use with the shelter shown in FIG. 36.

FIG. 49 illustrates a solar shade 250 for use with the one bay shelter shown in FIG. 36, and FIG. 50 illustrates a winter fly 252 for use with the one-bay shelter. Both assemblies are tensioned just at the gable ends with a parabolically curved wire rope which is anchored to the feet on the corner legs.

This wire rope acts similarly to the main support cable in a tension bridge, only inverted. This makes fitment and proper tensioning simpler.

The fabric cover 220 can be attached after the frame has been erected. Fabric cover 220 may be attached to the frame elements using fasteners such as hooks or hook and loop fasteners and in particular close haul j-hooks 29 at the eaves as previously noted above. Fabric dry bag style port closures are preferred. PALS (Pouch Attachment Ladder System)/Modular Lightweight Load-carrying Equipment i.e. PALS/MOLLE webbing attachment patches as universal hardware mounts may be incorporated. Universal webbing strip/patches may be sewn into the ceiling for attaching accessories such as air distribution ducts, lights, room dividers, etc. Glow in the dark, reversible, fabric exit signs may be used. Double layered windows allow visibility without losing insulating air gap between cover and insulation layer.

While a number of exemplary aspects and embodiments have been discussed above, those of skill in the art will recognize certain modifications, permutations, additions and sub combinations thereof. It is therefore intended that the invention be interpreted to include all such modifications, permutations, additions and sub combinations as are within their true spirit and scope.

The invention claimed is:

1. A folding tent frame component comprising:

a) first and second frame elements pivotally attached for relative rotation about a first axis of rotation located in said first element, between an open position capable of forming part of an erected tent frame and a closed folded position, said second frame element comprising a first end engaging said first axis of rotation;

b) a sliding locking frame slideably movable in said second frame element, said locking frame comprising a locking pin secured thereto and a lock-out bar pivotally mounted thereon and extending therefrom, c) first biasing means for biasing said sliding locking frame towards said first end of said second frame element and second biasing means for biasing said lock-out bar away from said sliding locking frame to an upward position;

wherein said first frame element comprises a pin-receiving slot with a closed end in the direction towards said axis of rotation and open in the opposite direction away from said axis of rotation for reversibly receiving said locking pin when said first and second frame elements are in said open position, and an opening for reversibly receiving a portion of said lockout bar when said sliding locking frame is moved away from said axis of rotation to withdraw said locking pin from said pin-receiving slot;

whereby when said locking pin is received in said pin-receiving slot said first and second frame elements are locked in said open position in the absence of other forces on said sliding locking frame, and when said sliding locking frame is moved away from said axis of rotation to withdraw said locking pin from said pin-receiving slot, said portion of said lock-out bar moves into said opening for reversibly receiving a portion of said lockout bar to thereby prevent said sliding locking frame from moving back towards said axis of rotation to again lock said first and second frame elements in said open position, and when said portion of said lock-out bar is received in said opening for reversibly receiving a portion of said lockout bar said first and second frame elements can be rotated to said second closed folded position;

and whereby when said first and second frame elements are rotated back to said open position said locking pin is moved back into said pin-receiving slot by said first biasing means to thereby again lock said first and second frame elements in said open position.

2. The folding tent frame component of claim 1 further comprising means attached to said sliding locking frame to allow an individual to pull it away from said axis of rotation.

3. The folding tent frame component of claim 1 wherein said lock-out bar is pivotally secured at one end thereof to said sliding locking frame and is sized and shaped at the opposite end to extend into said opening for reversibly receiving a portion of said lockout bar when said sliding locking frame is moved away from said axis of rotation to withdraw said locking pin from said pin-receiving slot.

4. A folding tent frame comprising a plurality of frame elements comprising the folding tent frame component of claim 1.

5. A method of assembling and disassembling a tent frame using a plurality of frame elements comprising the folding tent frame component of claim 1, by i) locking said first and second frame elements of one or more of said tent frame components in the open position to assemble said tent frame by rotating said first and second frame elements to said open position whereby said locking pin is moved into said pin-receiving slot by said first biasing means to lock said first and second frame elements in said open position; ii) to disassemble said tent frame, unlocking said first and second frame elements of said one or more tent frame components while maintaining said first and second frame elements in the open position by moving said sliding locking frame away from said axis of rotation to withdraw said locking pin from said pin-receiving slot, and said portion of said lock-out bar moving into said opening for reversibly receiving a portion of said lockout bar to thereby prevent said sliding locking frame from moving back towards said axis of rotation to again lock said first and second frame elements in said open position while disassembling said tent frame; and iii) subsequently rotating said first and second frame elements to said second closed folded position.

* * * * *